US009165701B2

(12) United States Patent
Chu et al.

(10) Patent No.: US 9,165,701 B2
(45) Date of Patent: Oct. 20, 2015

(54) RESISTANCE HEATING ELEMENT AND HEATING MEMBER AND FUSING DEVICE EMPLOYING THE SAME

(71) Applicant: Samsung Electronics Co., Ltd., Suwon-si, Gyeonggi-do (KR)

(72) Inventors: Kun-mo Chu, Seoul (KR); Dong-earn Kim, Seoul (KR); Sang-eui Lee, Hwaseong-si (KR); Dong-ouk Kim, Pyeongtaek-si (KR); Ha-jin Kim, Hwaseong-si (KR); Sung-hoon Park, Seoul (KR); Min-jong Bae, Yongin-si (KR); Yoon-chul Son, Hwaseong-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 44 days.

(21) Appl. No.: 14/093,906

(22) Filed: Dec. 2, 2013

(65) Prior Publication Data

US 2014/0205336 A1 Jul. 24, 2014

(30) Foreign Application Priority Data

Jan. 18, 2013 (KR) ..... 10-2013-0006064

(51) Int. Cl.

| | |
|---|---|
| ***G03G 15/20*** | (2006.01) |
| ***H01C 7/02*** | (2006.01) |
| ***H01C 7/04*** | (2006.01) |
| ***H05B 1/02*** | (2006.01) |

(52) U.S. Cl.

CPC ..... *H01C 7/021* (2013.01); *G03G 15/206* (2013.01); *G03G 15/2057* (2013.01); *H01C 7/041* (2013.01); *H05B 1/0241* (2013.01); *G03G 2215/2035* (2013.01); *H05B 2203/019* (2013.01); *H05B 2203/02* (2013.01)

(58) Field of Classification Search

CPC ..... G03G 15/206; G03G 15/2053; G03G 15/2057; H01C 7/021; H01C 7/041; H05B 1/0241

USPC ..... 399/333, 330, 329, 328

See application file for complete search history.

(56) References Cited

U.S. PATENT DOCUMENTS

| | | | | |
|---|---|---|---|---|
| 3,863,210 | A * | 1/1975 | Roland et al. | 340/450 |
| 5,224,017 | A | 6/1993 | Martin | |
| 5,560,898 | A | 10/1996 | Uchida et al. | |
| 5,648,056 | A | 7/1997 | Tanaka | |
| 5,780,101 | A | 7/1998 | Nolan et al. | |
| 5,820,995 | A * | 10/1998 | Niimi | 428/469 |
| 6,331,262 | B1 | 12/2001 | Haddon et al. | |
| 6,558,645 | B2 | 5/2003 | Nakayama et al. | |
| 6,764,628 | B2 | 7/2004 | Lobovsky et al. | |
| 6,764,874 | B1 | 7/2004 | Zhang et al. | |

(Continued)

FOREIGN PATENT DOCUMENTS

| | | | |
|---|---|---|---|
| GB | 2 445 464 | A * | 7/2008 |
| JP | 06092381 | B2 | 4/1994 |

(Continued)

*Primary Examiner* — Sophia S Chen

(74) *Attorney, Agent, or Firm* — Harness, Dickey & Pierce

(57) ABSTRACT

A resistance heating element includes a positive temperature coefficient resistance heating layer having a positive temperature coefficient, and a negative temperature coefficient resistance heating layer, which is connected to the positive temperature coefficient resistance heating layer and has a negative temperature coefficient.

18 Claims, 14 Drawing Sheets

(56) References Cited

U.S. PATENT DOCUMENTS

| | | | | |
|---|---|---|---|---|
| 6,905,667 | B1 | 6/2005 | Chen et al. | |
| 6,921,462 | B2 | 7/2005 | Montgomery et al. | |
| 6,921,575 | B2 | 7/2005 | Horiuchi et al. | |
| 7,247,670 | B2 | 7/2007 | Malenfant et al. | |
| 7,354,881 | B2 | 4/2008 | Resasco et al. | |
| 2003/0063931 | A1* | 4/2003 | Sanpei et al. | 399/339 X |
| 2009/0261089 | A1 | 10/2009 | Chang | |
| 2010/0143701 | A1 | 6/2010 | Zhu et al. | |
| 2011/0064873 | A1 | 3/2011 | Chang et al. | |
| 2012/0149547 | A1 | 6/2012 | Guo et al. | |
| 2012/0207525 | A1 | 8/2012 | Kim et al. | |
| 2012/0294659 | A1 | 11/2012 | Lee et al. | |
| 2013/0065152 | A1 | 3/2013 | Kim et al. | |
| 2013/0142552 | A1* | 6/2013 | Yoshida | 399/329 |
| 2013/0279932 | A1* | 10/2013 | Ishigai et al. | 399/69 |
| 2013/0293242 | A1* | 11/2013 | Kohn et al. | 324/511 |
| 2013/0302074 | A1 | 11/2013 | Lee et al. | |
| 2014/0053393 | A1 | 2/2014 | Lee et al. | |
| 2014/0205336 | A1 | 7/2014 | Chu et al. | |

FOREIGN PATENT DOCUMENTS

| | | | |
|---|---|---|---|
| JP | 11282548 | B2 | 10/1999 |
| JP | 2000058228 | B2 | 2/2000 |
| JP | 2004255481 | B2 | 9/2004 |
| JP | 2005089738 | A | 4/2005 |
| JP | 2005097499 | B2 | 4/2005 |
| KR | 1020090108601 | A | 10/2009 |
| KR | 10-2013-0097479 | | 9/2013 |

* cited by examiner (PTC on NTC, NTC to NTC)

(PTC on NTC, NTC to PTC)

(NTC on PTC, PTC to NTC)

(NTC on PTC, PTC to PTC)

RESISTANCE HEATING ELEMENT AND HEATING MEMBER AND FUSING DEVICE EMPLOYING THE SAME

This application claims priority to Korean Patent Application No. 10-2013-0006064, filed on Jan. 18, 2013, and all the benefits accruing therefrom under 35 U.S.C. §119, the content of which in its entirety is herein incorporated by reference.

BACKGROUND

1. Field

The disclosure relates to a resistance heating element, and a heating member and a fusing device including the resistance heating element.

2. Description of the Related Art

A relative change of electric resistance according to change of temperature of a resistance heating element is defined as a temperature coefficient of electrical resistance. A resistance heating element is referred to as having a negative temperature coefficient ("NTC") tendency when the resistance thereof decreases as temperature increases, and a resistance heating element is referred to as having a positive temperature coefficient ("PTC") tendency when the resistance thereof increases as temperature increases. While most of materials exhibit PTC tendencies, nano-composite materials may exhibit NTC tendencies according to material properties of matrixes and combinations of fillers.

Resistance heating elements may be applied to various fields. For example, a resistance heating element may be applied to a fusing device of an electrophotographic image forming apparatus. An electrophotographic image forming apparatus forms a visible toner image on an image receptor by supplying a toner to an electrostatic latent image formed on the image receptor, transfers the toner image to a printing medium, and fuses the transferred toner image to the printing medium. A toner is typically manufactured by adding various functional additives, such as colorants, to a base resin. A fusing operation includes applications of heat and pressure to a toner. Substantial portion of energy consumed by an electrophotographic image forming apparatus is consumed during a fusing operation. A resistance heating element may be employed as a heating member for applying heat to a toner. At a fusing device of an image forming apparatus, if resistance of a resistance heating element changes significantly during the initial warm-up, applied power changes significantly during a short period of time such that overheating may occur.

SUMMARY

Provided are embodiments of a resistance heating element with a relatively small resistance changing ratio during heating, and embodiments of a heating member and a fusing device including the resistance heating element.

Provided are embodiments of a resistance heating element with quick heating and improved durability, and embodiments of a heating member and a fusing device including the resistance heating element.

Additional aspects will be set forth in part in the description which follows and, in part, will be apparent from the description, or may be learned by practice of the presented embodiments.

According to an embodiment of the invention, a resistance heating element includes a positive temperature coefficient ("PTC") resistance heating layer having a positive temperature coefficient; and a negative temperature coefficient ("NTC") resistance heating layer which is electrically connected to the PTC resistance heating layer and has a negative temperature coefficient.

In an embodiment, the PTC resistance heating layer may include a first base polymer and first electroconductive fillers which are dispersed in the first base polymer and form a first conductive network, and the NTC resistance heating layer may include a second base polymer and second electroconductive fillers which are dispersed in the second base polymer and form a second conductive network.

In an embodiment, an aspect ratio of the first electroconductive fillers may be less than about 10, and an aspect ratio of the second electroconductive fillers may be equal to or greater than about 10.

In an embodiment, a resistance changing ratio of the PTC resistance heating layer according to temperature may be equal to or greater than about 10%. A resistance changing ratio of the NTC resistance heating layer according to temperature may be equal to or greater than about 10%.

In an embodiment, the resistance heating element may further include an input electrode and an output electrode which supply currents to the resistance heating element, where the PTC resistance heating layer and the NTC resistance heating layer may be one of a structure in which the PTC resistance heating layer and the NTC resistance heating layer are stacked, a structure in which the NTC resistance heating layer is arranged on and between first and second portions of the PTC resistance heating layers, which are spaced apart from each other, and a structure in which the NTC resistance heating layer is arranged between the first and second portions of the PTC resistance heating layer, and the input electrode and the output electrode may have one of a structure in which the input electrode and the output electrode are connected to the PTC resistance heating layer, a structure in which the input electrode and the output electrode are connected to the NTC resistance heating layer, and a structure in which the input electrode is connected to one of the PTC resistance heating layer and the NTC resistance heating layer and the output structure is connected to the other of the PTC resistance heating layer and the NTC resistance heating layer.

In an embodiment, a resistance ratio of resistance of the PTC resistance heating layer with respect to resistance of the NTC resistance heating layer may have a predetermined value, such that the resistance changing ratio of the resistance heating element is within about ±40%.

In an embodiment, the resistance heating element may further include an input electrode and an output electrode, which supply currents to the resistance heating element, where the input electrode and the output electrode may be connected to one of the PTC resistance heating layer and the NTC resistance heating layer, which has greater resistance.

In an embodiment, a resistance changing ratio of the other of the PTC resistance heating layer and the NTC resistance heating layer, to which the input electrode and the output electrode are not connected, may be less than a resistance changing ratio of the one of the PTC resistance heating layer and the NTC resistance heating layer, to which the input electrode and the output electrode are connected.

In an embodiment, the input electrode and the output electrode may be connected to the PTC resistance heating layer, and a resistance ratio of resistance of the PTC resistance heating layer with respect to resistance of the NTC resistance heating layer may be greater than or equal to about 2.

According to another embodiment of the invention, a heating member includes an input electrode and an output electrode; and the resistance heating element which generates heat using electricity supplied via the input electrode and the output electrode.

In an embodiment, the supporting unit may have a hollow pipe-like shape or a belt-like shape.

According to another embodiment of the invention, a fusing device includes the heating member; and a nib forming unit, which faces the heating member and forms a fusing nib.

BRIEF DESCRIPTION OF THE DRAWINGS

These and/or other features will become apparent and more readily appreciated from the following description of the embodiments, taken in conjunction with the accompanying drawings, of which.

DETAILED DESCRIPTION

Figure 1:
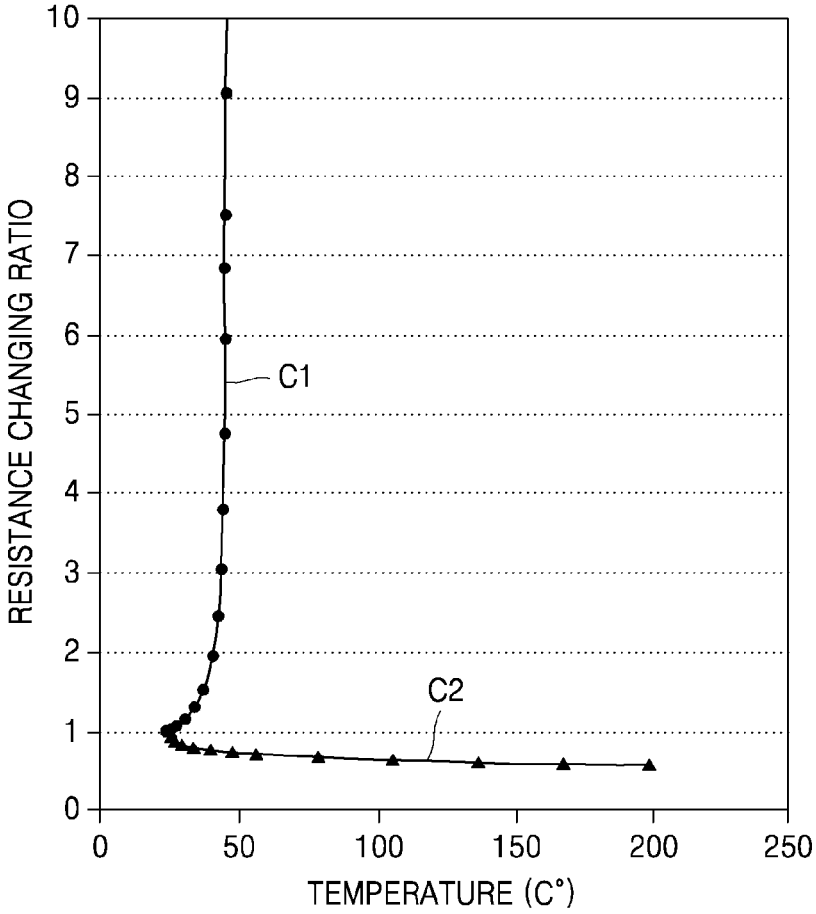
FIG. 1 is a graph of resistance change ratio versus temperature showing negative temperature coefficient ("NTC") characteristics and positive temperature coefficient ("PTC") characteristics of a resistance heating element.

The invention will be described more fully hereinafter with reference to the accompanying drawings, in which exemplary embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," "connected to" or "coupled to" another element or layer, the element or layer can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

Hereinafter, embodiments of a resistance heating element and embodiments of a heating member and a fusing device including the resistance heating element according to the invention will be described in further detail with reference to the accompanying drawings.

An embodiment of a resistance heating element may be a polymer resistance heating element that includes a base polymer and electroconductive fillers distributed in the base polymer. In such an embodiment, the base polymer may be a thermally stable polymer. In one embodiment, for example, the base polymer may be a highly thermal-resistant polymer, such as silicon rubber, polyimide, polyamide, polyimide-amide, and fluoropolymers. In one embodiment, where the base polymer includes a fluoropolymer, the fluoropolymer may be a perfluoroelastomer, such as perfluoroalkoxy polymer ("PFA") and polytetrafluoroethylenes ("PTFE"), for example, or a fluorinated polymer, such as fluorinated polyetherketones ("PEEK") and fluorinated ethylene propylene ("FEP"), for example. In an embodiment, the base polymer may include at least one of the above-stated polymers. In one embodiment, for example, the base polymer may be one of the above-stated polymers, or a blend or a copolymer of at least two of the above-stated polymers. In such an embodiment, the base polymer may include a material based on a predetermined hardness of the base polymer according to the application of the resistance heating element including the base polymer.

In an embodiment, the electroconductive fillers of the resistance heating element may be metal fillers or carbon-based fillers, for example. In an embodiment, where the resistance heating element includes the metal fillers, the metal fillers may be metal particles, e.g., Ag, Ni, Cu, Fe, etc. In an embodiment, where the resistance heating element includes the carbon-based fillers, the carbon-based fillers may be carbon nanotubes ("CNT"), carbon black, carbon nanofibers, graphene, expanded graphite, graphite nanoplatelets or graphite oxide ("GO"), for example. In such an embodiment, the electroconductive fillers may be the above-stated particles coated with other conductive materials. In such an embodiment, the electroconductive fillers may be the above-stated particles doped with conductive materials. The electroconductive fillers may be any of various types of electroconductive filler, such as fiber type electroconductive filler or particle type electroconductive filler, for example.

In such an embodiment, where the resistance heating member includes the based polymer and the electroconductive fillers, the electroconductive fillers are distributed in the base polymer and form an electroconductive network. In general, CNTs may form a conductor or a resistor having conductivity in a range from about $10^{-4}$ siemens per meter (S/m) to about 100 siemens per meter (S/m) according to content thereof. The CNT has high conductivity similar to conductivities of metals and has substantially low density. Therefore, heat capacity (heat capacity=density×specific heat) per unit volume of CNT is about 3 to 4 times lower than heat capacity per unit volume of a conventional resistive material. In an embodiment, where the electroconductive fillers of the resistance heating element include CNTs, temperature of the resistance heating element may substantially rapidly change. In one embodiment, for example, a heating member for a fusing device of a printer may include a resistance heating element including electroconductive fillers, such that warm-up time from print stand-by state to printing state may be reduced, and thus a first page may be quickly printed. In such an embodiment, a preheating process of a heating member at a stand-by state may be substantially reduced or effectively omitted, such that power consumption may be reduced.

Electric resistance of a resistance heating element is changed as temperature increases. Change of electric resistance depends on type of electroconductive fillers. In one embodiment, for example, the resistance heating element includes particle type electroconductive fillers, and the resistance heating element exhibits positive temperature coefficient ("PTC") characteristics. In such an embodiment, as temperature increases, electric resistance of the resistance heating element increases. In one embodiment, for example, where the resistance heating element includes fiber type electroconductive fillers, the resistance heating element exhibits negative temperature coefficient ("NTC") characteristics. In such an embodiment, as temperature increases, electric resistance of the resistance heating element decreases.

FIG. 1 is a graph of resistance change ratio versus temperature showing negative temperature coefficient ("NTC") characteristics and positive temperature coefficient ("PTC") characteristics of a resistance heating element. FIG. 1 shows a result of measuring electric resistance changing ratio of a resistance heating element according to temperature in an embodiment where the resistance heating element includes the particle type electroconductive fillers and in an embodiment where the resistance heating element includes the fiber type electroconductive fillers. In such embodiments, the resistance heating element includes polydimethylsiloxane ("PDMS"), which is a type of silicon rubbers as the base polymer. In such embodiments, the resistance heating element may include carbon black of about 150 parts per hundred resin ("phr") as the particle type electroconductive fillers, and include multi-walled carbon nanotubes ("MWCNT"s) of about 12 phr as the fiber type electroconductive fillers. The aspect ratio of the MWCNTs is about 150 or higher. In the graph shown in FIG. 1, the horizontal axis indicates temperature, and the vertical axis indicates resistance changing ratio. The resistance changing ratio is a ratio of resistance R of each temperature with respect to the resistance $R_0$ at the room temperature (e.g., about 25° C.). Referring to FIG. 1, in an embodiment where the resistance heating element includes carbon black as the electroconductive fillers (C1 in FIG. 1), a PTC characteristic in which resistance rapidly increases while temperature of the resistance heating element is rising to about 50° C. is exhibited. In an embodiment where the resistance heating element includes CNTs as the electroconductive fillers (C2 in FIG. 1), an NTC characteristic in which resistance decreases to about 38% while temperature of the resistance heating element is rising to about 200° C. is exhibited. Although not shown in FIG. 1, in an embodiment, where the content of the CNTs is increased to about 15 phr, resistance of the resistance heating element decreases by about 58%.

Figure 2:
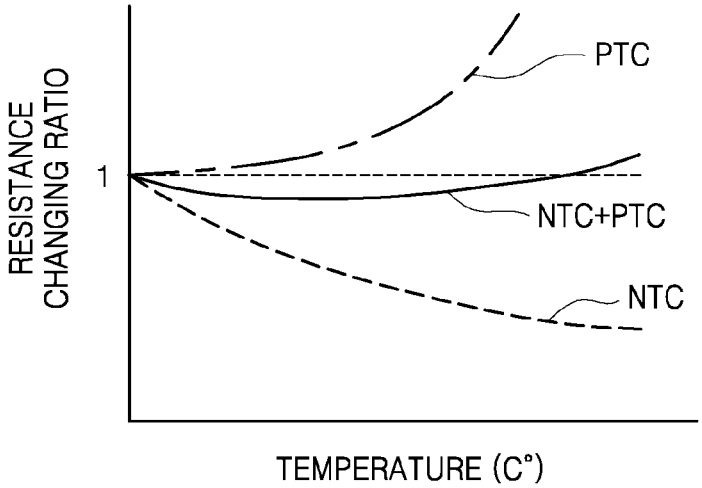
FIG. 2 is a graph of resistance change ratio versus temperature showing controlling of a resistance changing ratio to within a predetermined range.

FIG. 2 is a graph of resistance change ratio versus temperature showing controlling of a resistance changing ratio to within a predetermined range. In an embodiment of the resistance heating element according to the invention, the resistance heating element includes a PTC resistance heating element having a PTC characteristic and a NTC resistance heating element having an NTC characteristic, which are electrically connected to each other, such that the resistance changing ratio of the resistance heating element according to increase of temperature may be controlled to be within a predetermined range as shown in FIG. 2, and for example, resistance changing ratio of the PTC resistance heating layer according to temperature may be equal to or greater than 10%, and resistance changing ratio of the NTC resistance heating layer according to temperature may be equal to or greater than 10%.

(1) Hybrid Structure

Figure 3:
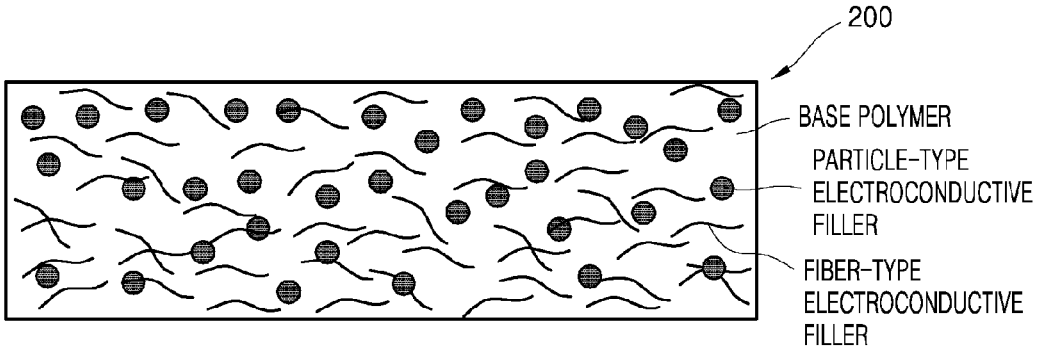
FIG. 3 is a diagram showing an embodiment of an resistance heating element, which is a hybrid type resistance heating element.

FIG. 3 is a diagram showing an embodiment of a resistance heating element, which is a hybrid type resistance heating element. Referring to FIG. 3, a resistance heating element 200 may be a hybrid type resistance heating element having a hybrid structure including a base polymer, and particle type electroconductive fillers (first electroconductive fillers) for applying PTC characteristics and fiber type electroconductive fillers (second electroconductive fillers) for applying NTC characteristics, which are mixed and dispersed into the base polymer. In such an embodiment, the particle type electroconductive fillers may be carbon black or fullerene, for example, and the fiber type electroconductive fillers may be CNTs, for example. Electroconductive fillers may be categorized into particle type and fiber type based on aspect ratio of the fillers, for example. In an embodiment, electroconductive fillers having an aspect ratio less than 10 may be defined as particle type electroconductive fillers, and electroconductive fillers having an aspect ratio equal to or greater than 10 may be defined as fiber type electroconductive fillers.

Figure 4:
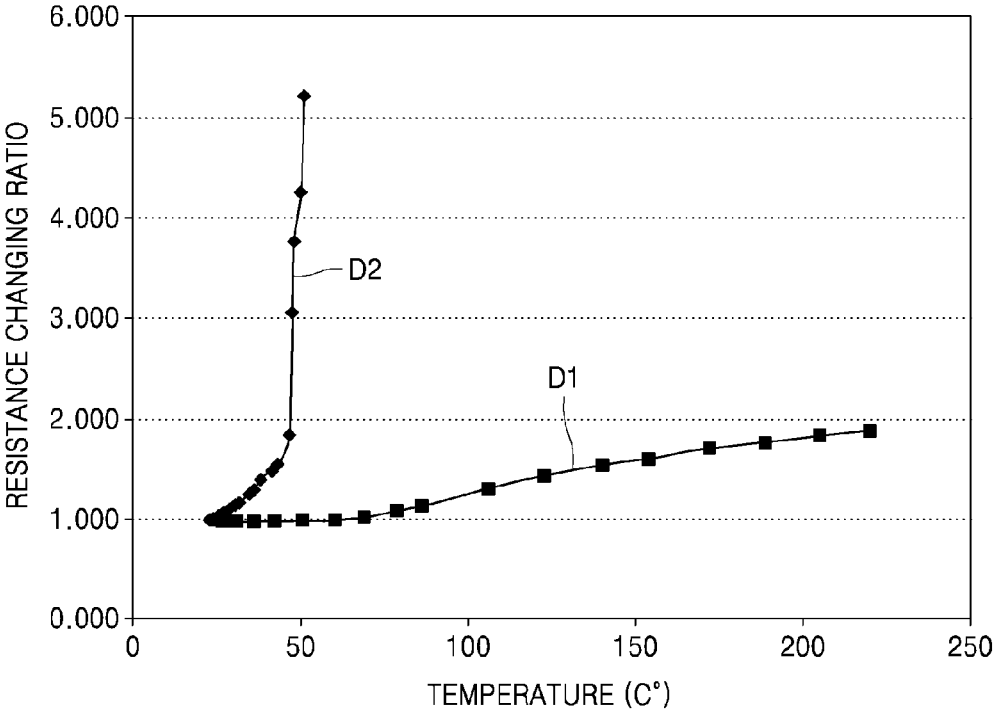
FIG. 4 is a graph showing resistance changing ratio versus temperature of the hybrid type resistance heating element shown in FIG. 3.

FIG. 4 is a graph showing resistance changing ratio versus temperature of the hybrid type resistance heating element shown in FIG. 3. FIG. 4 shows a graph showing the resistance changing ratio of the resistance heating element 200 having the hybrid structure according to an embodiment of the invention as shown in FIG. 3. The resistance heating element 200 having the hybrid structure including about 0.5 phr of MWCNTs having an aspect ratio equal to or greater than 150 and about 150 phr of carbon black, which are dispersed into the PDMS. In FIG. 4, D1 denotes the resistance changing ratio of an embodiment of the resistance heating element 200, and D2 denotes the resistance changing ratio in a comparative embodiment, where about 150 phr of carbon black is dispersed into the PDMS.

Referring to FIG. 4, an embodiment of the resistance heating element 200 having the hybrid structure exhibits relatively weak PTC characteristics, where curve of the resistance changing ratio is relatively flat compared to the comparative embodiment in which only carbon black is added. In an embodiment, although the base polymer expands as temperature rises, the MWCNTs function as conductive bridges between carbon black, thereby suppressing rapid increase of resistance. Therefore, an embodiment of the resistance heating element 200 having small resistance change ratio (e.g., equal to or less than about ±40%, and more particularly, equal to or less than about ±10%) within a predetermined range of temperatures may be formed by controlling contents of particle type electroconductive fillers and fiber type electroconductive fillers.

(2) Stacked Structure (Parallel Structure)

FIGS. 5A to 5D are diagrams showing embodiments of a resistance heating element having a stacked structure and electrodes. In an embodiment, the resistance heating element may have a stacked structure, in which a PTC resistance heating layer P10 and an NTC resistance heating layer N10 are stacked. In such an embodiment, the PTC resistance heating layer P10 may include a base polymer (e.g., a first base polymer) and particle type electroconductive fillers (e.g., first electroconductive fillers) that are dispersed in the first base polymer to form a conductive network (e.g., a first conductive network). In such an embodiment, the NTC resistance heating layer N10 may include a base polymer (e.g., a second base polymer) and fiber type electroconductive fillers (e.g., second electroconductive fillers) that are dispersed in the second base polymer to form a conductive network (e.g., a second conductive network)

In the perspective of current path, a resistance heating element 210 having the stacked structure may be understood as the structure in which the PTC resistance heating layer P10 and the NTC resistance heating layer N10 are connected in parallel. FIGS. 5A to 5D show embodiments of a resistance heating element having the stacked structure, and an electric circuit and a total resistance corresponding thereto. In such embodiments, for example, the PTC resistance heating layer P10 may be formed by dispersing about 150 phr of carbon black in PDMS, and the NTC resistance heating layer N10 may be formed by dispersing about 12 phr of MWCNTs having an aspect ratio equal to or greater than 150 in PDMS.

Figure 5A:
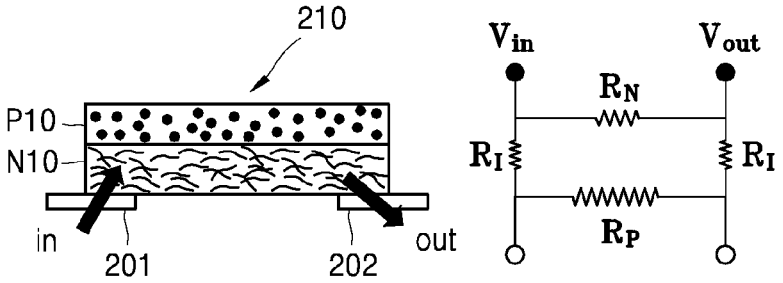
FIGS. 5A to 5D are diagrams showing embodiments of a resistance heating element having a stacked structure and electrodes.

FIG. 5A shows an embodiment of a resistance heating element having a PTC on NTC structure in which the PTC resistance heating layer P10 is stacked on the NTC resistance heating layer N10. Electrodes 201 and 202 are connected to the NTC resistance heating layer N10. In FIG. 5A, an equivalent electric circuit (NTC to NTC) of the resistance heating element 210 is also shown. In the equivalent circuit in FIG.

5A, Vin and Vout denote input voltage and output voltage, respectively. The total resistance $R_T$ of the resistance heating element 210 may be expressed as the equation below.

$$R_T = \frac{2R_N R_I + R_N R_P}{(R_N + R_P) + 2R_I}$$

In the above and below equations, $R_P$ denotes resistance of the PTC resistance heating layer P10, $R_N$ denotes resistance of the NTC resistance heating layer N10, $R_1$ denotes resistance of the interface between the PTC resistance heating layer P10 and the NTC resistance heating layer N10, and $R_T$ denotes the total resistance of the resistance heating element 210.

Figure 5B:
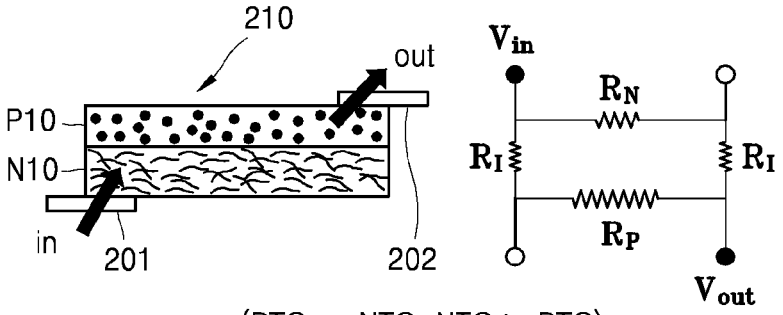

FIG. 5B shows an embodiment of a resistance heating element having a PTC on NTC structure in which the PTC resistance heating layer P10 is stacked on the NTC resistance heating layer N10. In such an embodiment, the electrodes 201 and 202 are respectively connected to the NTC resistance heating layer N10 and the PTC resistance heating layer P10. In FIG. 5B, an equivalent electric circuit (NTC to PTC) of the resistance heating element 210 is also shown. The total resistance $R_T$ may be expressed as the equation below.

$$R_T = \frac{(R_P + R_I)(R_N + R_I)}{(R_N + R_P) + 2R_I}$$

Figure 5C:
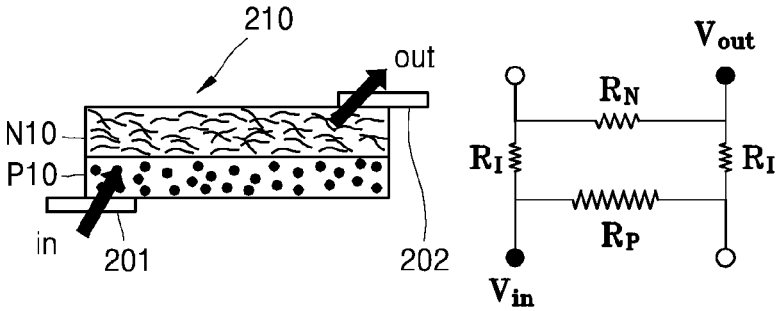

FIG. 5C shows an embodiment of a resistance heating element having a NTC on PTC structure in which the NTC resistance heating layer N10 is stacked on the PTC resistance heating layer P10. In such an embodiment, the electrodes 201 and 202 are respectively connected to the PTC resistance heating layer P10 and the NTC resistance heating layer N10. In FIG. 5C, an equivalent electric circuit (PTC to NTC) of the resistance heating element 210 is also shown. The total resistance $R_T$ may be expressed as the equation below.

$$R_T = \frac{(R_P + R_I)(R_N + R_I)}{(R_N + R_P) + 2R_I}$$

Figure 5D:
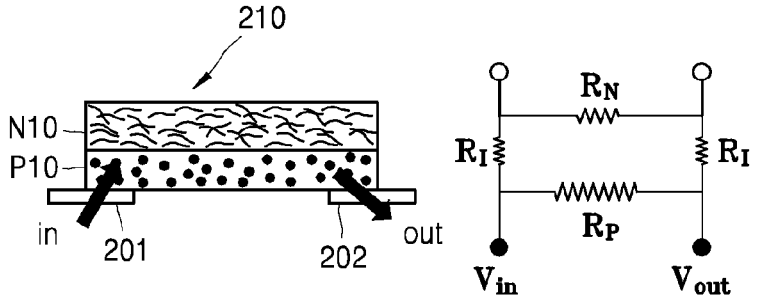

FIG. 5D shows an embodiment of a resistance heating element having a NTC on PTC structure in which the NTC resistance heating layer N10 is stacked on the PTC resistance heating layer P10. In such an embodiment, the electrodes 201 and 202 are connected to the PTC resistance heating layer P10. In FIG. 5D, an equivalent electric circuit (PTC to PTC) of the resistance heating element 210 is also shown. The total resistance $R_T$ may be expressed as the equation below.

$$R_T = \frac{2R_P R_I + R_N R_P}{(R_N + R_P) + 2R_I}$$

In such embodiments, the structures shown in FIG. 5B and FIG. 5C exhibit substantially the same total resistance $R_T$, and resistance changing ratios according to change of temperature of the embodiments are thereby substantially the same as each other. In such embodiments, the structures shown in FIGS. 5A and 5D exhibit greater total resistances $R_T$ than the structures shown in FIGS. 5B and 5C, where $R_P$ is much greater than $R_I$ and $R_N$.

When resistance of the PTC resistance heating layer P10 and resistance of the NTC resistance heating layer N10 are measured, the resistance of the PTC resistance heating layer P10 is greater than the resistance of the NTC resistance heating layer N10 when the PTC resistance heating layer P10 and the NTC resistance heating layer N10 have substantially the same size as each other. In one embodiment, for example, when resistance of a sample having a dimension of 18.8 millimeters (mm)×5.0 millimeters (mm)×0.97 millimeter (mm) is measured, the resistance of the PTC resistance heating layer P10 ($R_P$) is about 131.0 ohms (Ω) and the resistance of the NTC resistance heating layer N10 ($R_N$) is about 34.1Ω, such that the resistance of the PTC resistance heating layer P10 is about four times greater than the resistance of the NTC resistance heating layer N10. Therefore, in such embodiments, overall change of the total resistance $R_T$ substantially depends on the resistance changing ratio of the PTC resistance heating layer P10.

Figure 6:
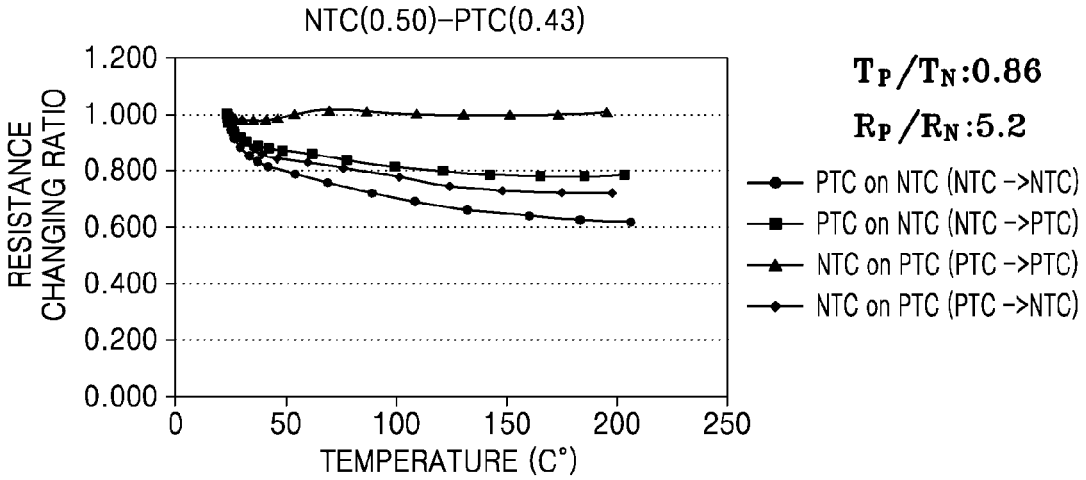
FIG. 6 is a graph showing resistance changing ratio versus temperature the embodiments of the resistance heating element and the electrodes shown in FIGS. 5A to 5D, where resistance ratio is 5.2.
Figure 7:
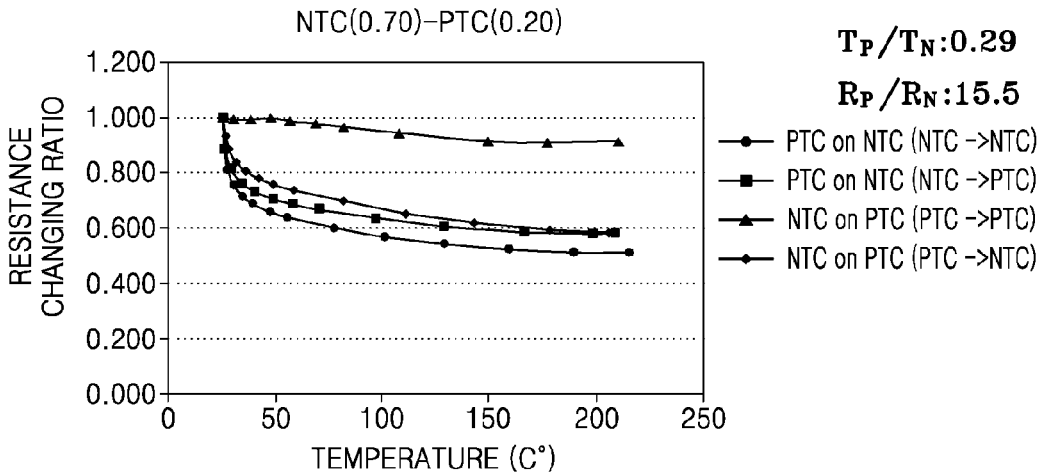
FIG. 7 is a graph showing resistance changing ratio versus temperature of the embodiment of the resistance heating element and the electrodes shown in FIGS. 5A to 5D, where resistance ratio is 15.5.

FIGS. 6 and 7 are graphs showing results of measuring resistance changing ratio of embodiments of the resistance heating element 210 having the stacked structure as shown in FIGS. 5A to 5D according to thickness ratios $T_P/T_N$ and resistance ratios $R_P/R_N$ of the PTC resistance heating layer P10 with respect to the NTC resistance heating layer N10. FIG. 6 shows the resistance changing ratio in an embodiment where the thickness $T_N$ of the NTC resistance heating layer N10 and the thickness $T_P$ of the PTC resistance heating layer P10 are about 0.5 mm and about 0.43 mm, respectively. In such an embodiment, the thickness ratio $T_P/T_N$ is about 0.86, and the resistance ratio $R_P/R_N$ is about 5.2. FIG. 7 shows the resistance changing ratio in an embodiment where the thickness $T_N$ of the NTC resistance heating layer N10 and the thickness $T_P$ of the PTC resistance heating layer P10 are about 0.7 mm and about 0.2 mm, respectively. In such an embodiment, the thickness ratio $T_P/T_N$ is about 0.29, and the resistance ratio $R_P/R_N$ is about 15.5.

Referring to FIGS. 6 and 7, the resistance changing ratio of embodiments of the resistance heating element 210 having the stacked structures shown in FIGS. 5A to 5D substantially exhibit NTC characteristics while temperature rises from the room temperature (e.g., about 25° C.) to about 200° C. As shown in FIGS. 6 and 7, the embodiments of the resistance heating element 210 the PTC on NTC (NTC to PTC) structure and the NTC on PTC (PTC to NTC) structure exhibit a similar resistance changing ratio. In such embodiments, an embodiment of the resistance heating element having the NTC on PTC (PTC to PTC) structure exhibits smaller resistance changing ratio than an embodiment of the resistance heating element having the PTC on NTC (NTC to NTC) structure.

Figure 8A:
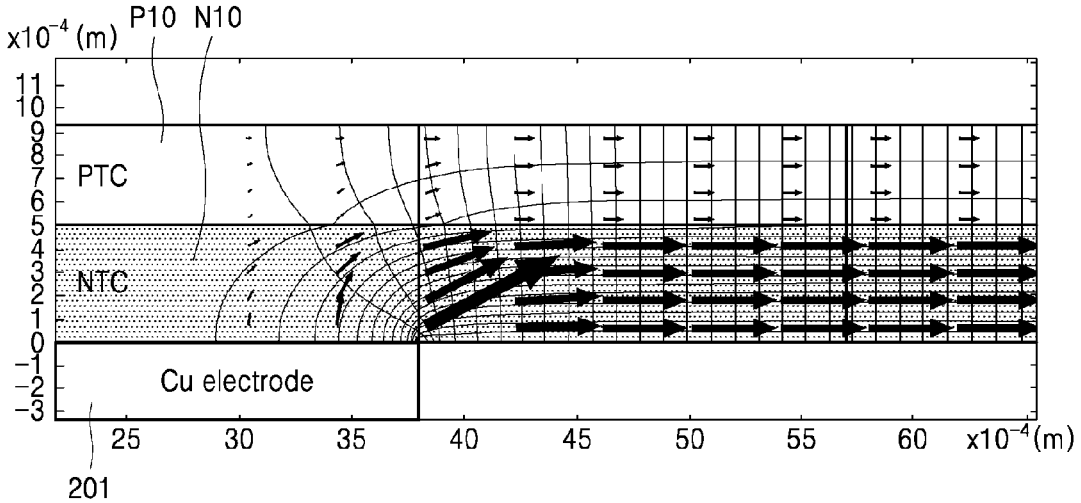
FIGS. 8A and 8B are diagrams showing directions of current flows and current density in an embodiment of a resistance heating element having a PTC to NTC structure and in an embodiment of a resistance heating element having an NTC to PTC structure.
Figure 8B:
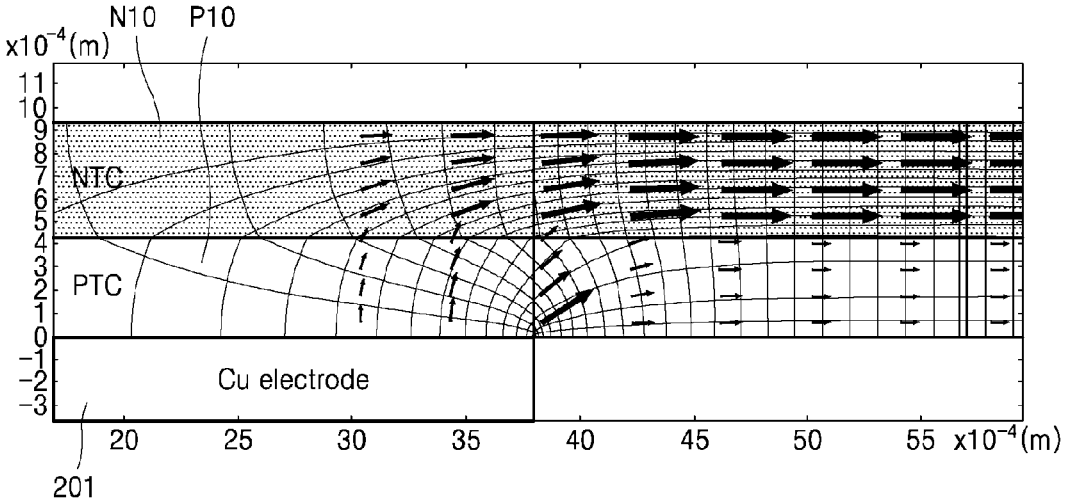
Figure 8C:
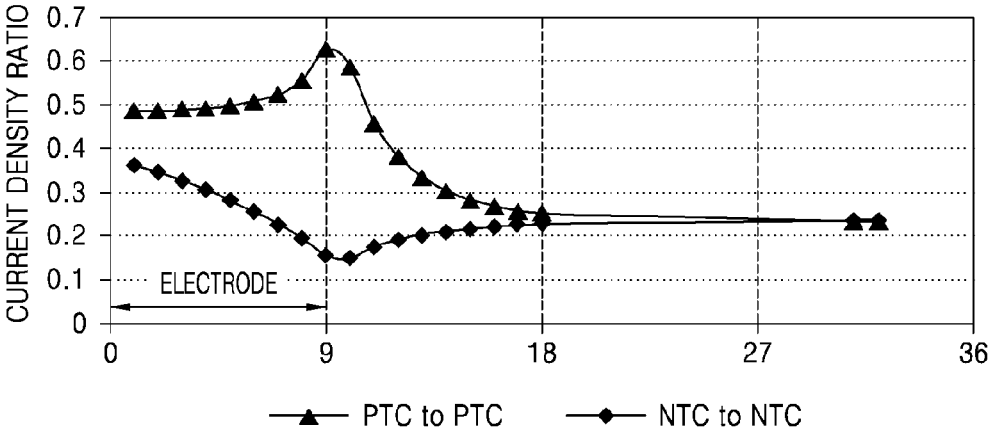
FIG. 8C is a graph showing current density ratios in an embodiment of a resistance heating element having the PTC to NTC structure and in an embodiment of a resistance heating element having the NTC to PTC structure.

FIGS. 8A and 8B show results of simulating current flows through the NTC resistance heating layer N10 and the PTC resistance heating layer P10 with respect to the thicknesses of the NTC resistance heating layer N10 and the PTC resistance heating layer P10 in an embodiment of the resistance heating element having the PTC on NTC (NTC to NTC) structure and in an embodiment of the resistance heating element having the NTC on PTC (PTC to PTC) structure shown in FIGS. 5A and 5D. In the embodiments shown in FIGS. 8A and 8B, thickness of the NTC resistance heating layer N10 is about 0.5 mm, and thickness of the PTC resistance heating layer P10 is about 0.43 mm. FIG. 8C is a graph showing current density ratios that are density ratio of a current flowing to the PTC resistance heating layer P10 with respect to a current flowing to the NTC resistance heating layer N10 in the embodiments shown in FIGS. 8A and 8B.

Referring to FIGS. 8A to 8C, when the thicknesses of the NTC resistance heating layer N10 and the PTC resistance heating layer P10 are predetermined, e.g., about 0.5 mm and about 0.43 mm, respectively, the current density ratios are different when the electrodes 201 and 202 contact the NTC resistance heating layer N10 and when the electrodes 201 and 202 contact the PTC resistance heating layer P10. Referring to FIG. 8C, when the electrodes 201 and 202 contact the PTC resistance heating layer P10 (that is, current path is PTC to PTC), current density ratio is relatively high. Accordingly, substantially high current flows to the PTC resistance heating layer P10 in an embodiment of the resistance heating element having the NTC on PTC (PTC to PTC) structure, and thus the resistance changing ratio of the resistance heating element 210 may be effectively controlled in such an embodiment.

Figure 9A:
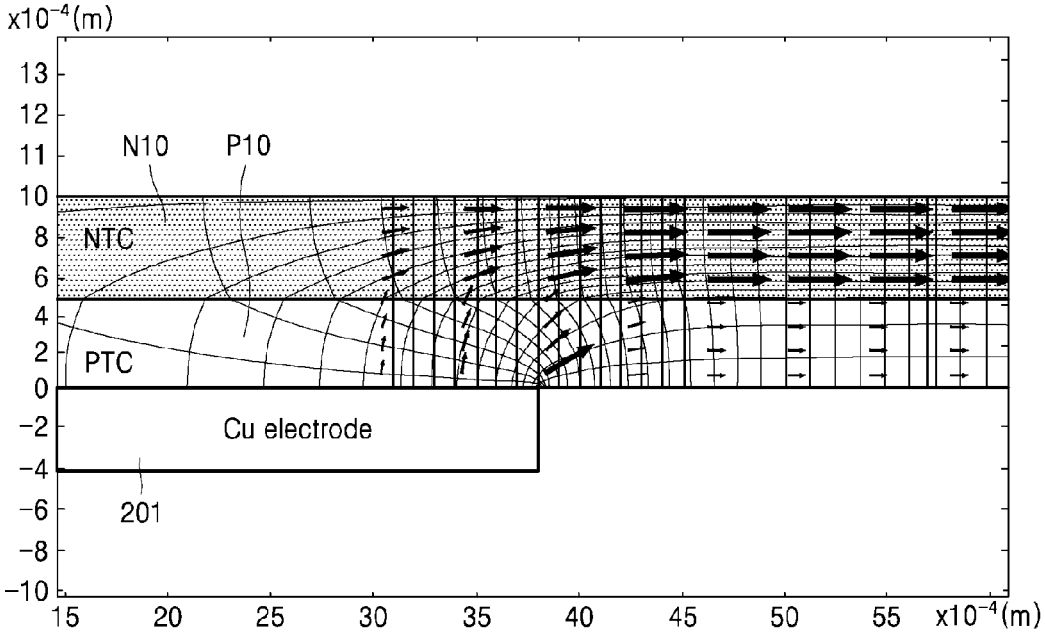
FIGS. 9A and 9B are diagrams showing current flows according to thickness of a PTC resistance heating layer in an NTC to PTC structure.
Figure 9B:
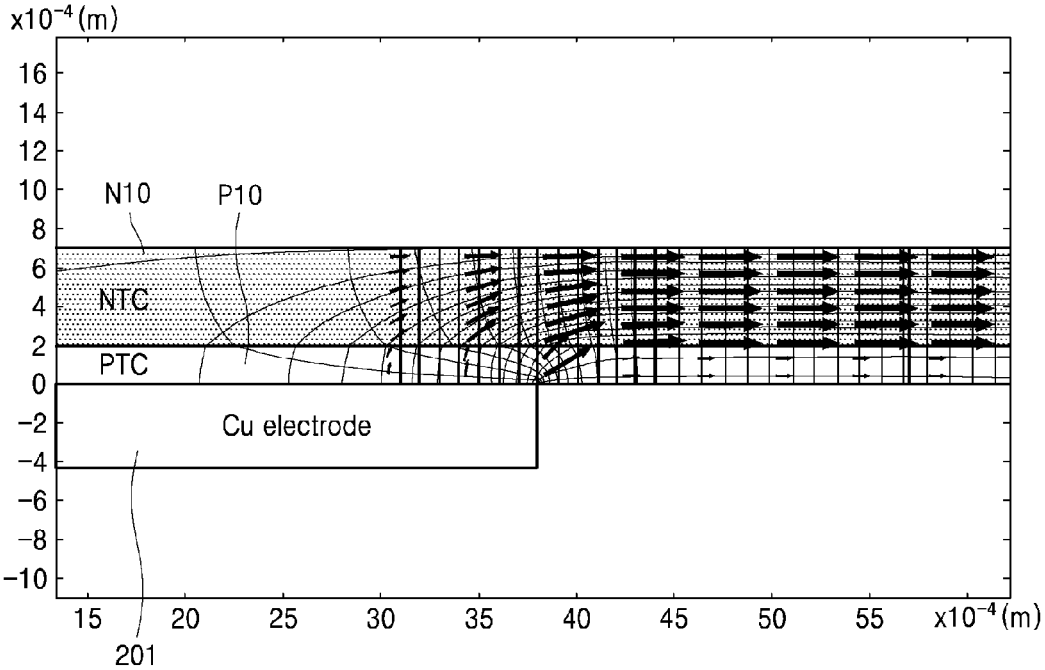
Figure 9C:
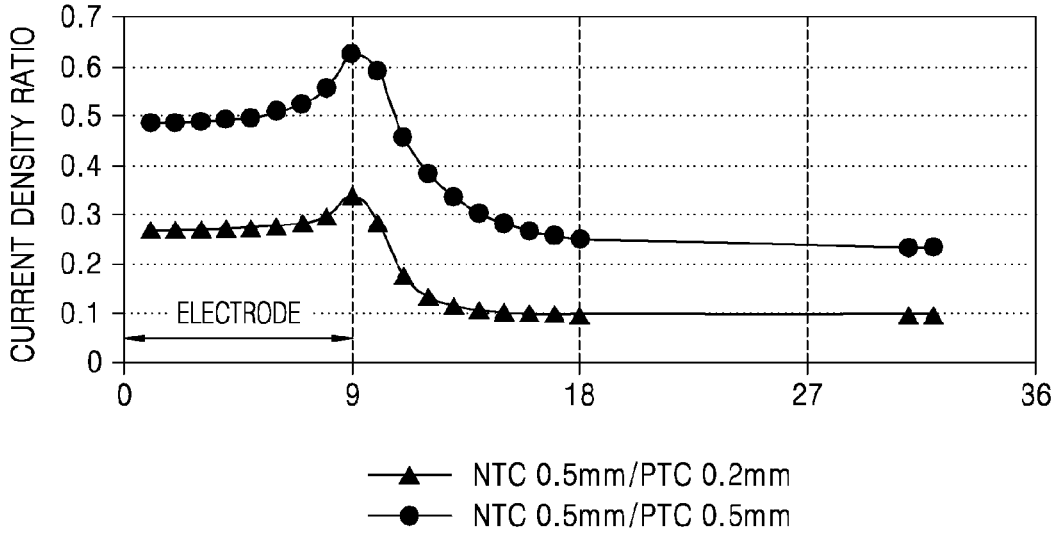
FIG. 9C is a graph showing current density ratios in the structures shown in FIGS. 9A and 9B.

FIGS. 9A and 9B show results of simulating current flows in an embodiment where the thickness of the PTC resistance heating layer P10 is changed with respect to the given thickness of the NTC resistance heating layer N10 in the NTC on PTC (PTC to PTC) structure shown in FIG. 5D. In the embodiments shown in FIGS. 9A and 9B, the thickness of the NTC resistance heating layer N10 is about 0.5 mm. In FIGS. 9A and 9B, thicknesses of the PTC resistance heating layer P10 are about 0.5 mm and about 0.2 mm, respectively. FIG. 9C shows current density ratios that are density ratios of a current flowing to the PTC resistance heating layer P10 with respect to a current flowing to the NTC resistance heating layer N10 in the embodiments shown in FIGS. 9A and 9B. Referring to FIGS. 9A to 9C, in an embodiment, density of a current flowing into the PTC resistance heating layer P10 increases as thickness of the PTC resistance heating layer P10 increases. In such an embodiment, by fixing the thickness of the NTC resistance heating layer N10 and changing the thickness of the PTC resistance heating layer P10, the current density ratio between currents flowing into the PTC resistance heating layer P10 and the NTC resistance heating layer N10 may be effectively controlled. In such an embodiment, the resistance changing ratio of the resistance heating element 210 may be controlled by controlling a current density ratio.

Table 1 below shows resistance changing ratios of an embodiment of the resistance heating element having the NTC on PTC (PTC to PTC) structure (e.g., the embodiment shown in FIG. 5D) and an embodiment of the resistance heating element having the PTC on NTC (NTC to NTC) structure (e.g., the embodiment shown in FIG. 5A) that are measured by changing the resistance ratio $R_P/R_N$ between the PTC resistance heating layer P10 and the NTC resistance heating layer N10 while the temperature rises from the room temperature to about 200° C. In an embodiment, the resistance heating elements 210 having different resistance ratios $R_P/R_N$ are provided by changing the thickness ratio $T_P/T_N$. Referring to Table 1, the resistance heating element 210 exhibiting a change of resistance within about ±10% may be provided by appropriately selecting the $R_P/R_N$ and the current path.

TABLE 1

| | | | | |
|---|---|---|---|---|
| Thickness Ratio ($T_P/T_N$) | 0.86 | | 0.29 | |
| Resistance Ratio ($R_P/R_N$) | 5.2 | | 15.5 | |
| Stacked Structure | PTC on NTC | NTC on PTC | PTC on NTC | NTC on PTC |
| Current Path | NTC to NTC | PTC to PTC | NTC to NTC | PTC to PTC |
| Change of Resistance | −38% | +0.8% | −48.6% | −8.8% |

Based on the above result shown in Table 1, a structure of an embodiment of the resistance heating element may be determined.

In an embodiment, to reduce the resistance changing ratio of the resistance heating element 210 having a stacked structure according to temperature, the electrodes 201 and 202 may be connected to the resistance layer among NTC resistance heating layer N10 and the PTC resistance heating layer P10, which exhibits greater resistance. In such an embodiment, to reduce the resistance changing ratio of the resistance heating element 210 having a stacked structure according to temperature, the resistance changing ratio of one of the NTC resistance heating layer N10 and the PTC resistance heating layer P10, in which more current flows, may be smaller than the resistance changing ratio of the other of the NTC resistance heating layer N10 and the PTC resistance heating layer P10.

In one embodiment, for example, the resistance heating element corresponding to one of four cases shown in Table 2 below may be considered. In one embodiment corresponding to the case 2, the electrodes 201 and 202 are disposed on the PTC resistance heating layer P10 having relatively large resistance, and thus more current flows to the NTC resistance heating layer N10 having relatively small resistance. However, since the NTC resistance heating layer N10 exhibits greater resistance changing ratio, the overall resistance changing ratio is substantially great. In one embodiment corresponding to the case 3, the electrodes 201 and 202 are disposed on the NTC resistance heating layer N10 having relatively large resistance, and thus more current flows to the PTC resistance heating layer P10 having relatively small resistance. However, since the PTC resistance heating layer P10 exhibits greater resistance changing ratio, the overall resistance changing ratio is also substantially great. In embodiments corresponding to the case 1 and case 4, the resistance changing ratio of the resistance heating element 210 is substantially reduced.

TABLE 2

| | Resistance Changing Ratio | | Resistance | | Electrode |
|---|---|---|---|---|---|
| | NTC | PTC | NTC | PTC | Location |
| Case 1 | > | | > | | N |
| Case 2 | > | | < | | P |
| Case 3 | < | | > | | N |
| Case 4 | < | | < | | P |

In an embodiment, the resistance changing ratio of the resistance heating element 210 having the stacked structure according to temperature may be controlled to be within a predetermined range, e.g., about ±40% (in an alternative embodiment, about ±10%) by changing the resistance ratio $R_P/R_N$ between the PTC resistance heating layer P10 and the NTC resistance heating layer N10 in the stacked structure. In such an embodiment, the resistance ratio $R_P/R_N$ may be controlled by controlling the thickness ratio $T_P/T_N$. In such an embodiment, the resistance ratio $R_P/R_N$ may be controlled by changing types and contents of the electroconductive fillers. The mechanical characteristics of the resistance heating element 210 are affected by types and contents of the electroconductive fillers. Therefore, contents of the electroconductive fillers that may be included in the resistance heating element 210 are limited. In such an embodiment, the resistance ratio $R_P/R_N$ may be effectively controlled by controlling the thickness ratio $T_P/T_N$.

In an embodiment, the resistance heating element 210 may have the NTC on PTC (PTC to PTC) structure to reduce resistance changing ratio. In such an embodiment, to reduce resistance changing ratio, the electrodes 201 and 202 may contact the PTC resistance heating layer P10.

The resistance changing ratio of the resistance heating element 210 is mainly affected by the resistance changing ratios of the PTC resistance heating layer P10 and the NTC resistance heating layer N10 at a temperature in a range from the room temperatures to about 50° C. Referring back to FIG. 1, the resistance changing ratio of the PTC resistance heating layer P10 rapidly increases at the temperatures from the room temperature to about 50° C., and the resistance changing ratio of the NTC resistance heating layer N10 at a temperature equal to or greater than about 50° C. is less than or equal to about 15%. Therefore, the resistance ratio $R_P/R_N$ may be controlled to make the resistance changing ratio of the resistance heating element 210 to be within a predetermined range at the temperatures in the range from the room temperatures to about 50° C., thereby effectively maintaining a substantially small resistance changing ratio at a predetermined temperature range.

Figure 10:
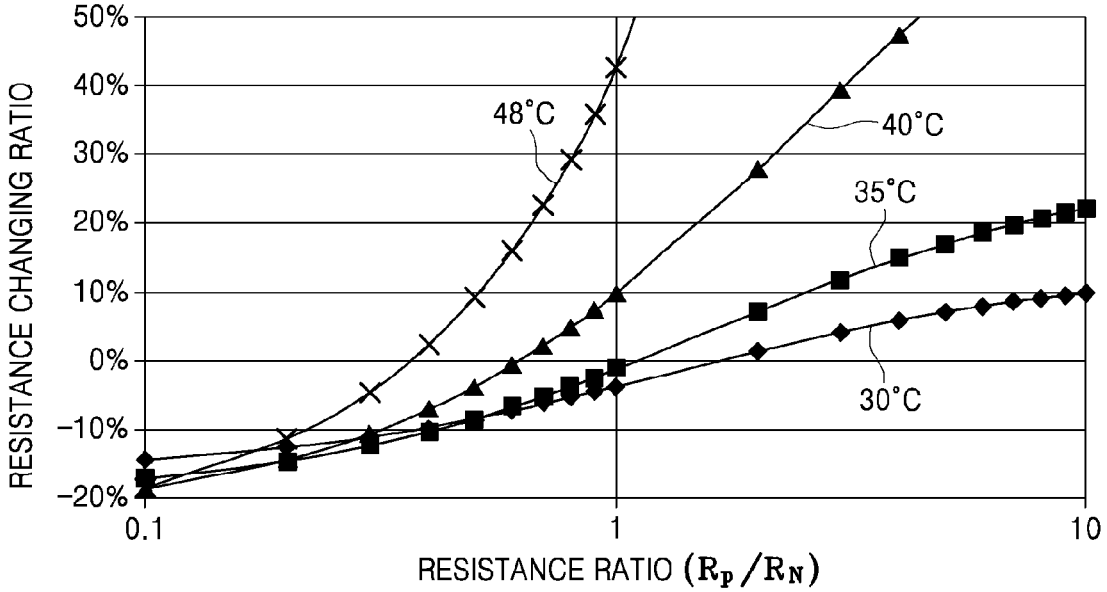
FIG. 10 is a graph showing resistance changing ratio versus resistance ratio.

FIG. 10 is a graph showing relationships between the resistance ratio $R_P/R_N$ and the resistance changing ratio of an embodiment of the resistance heating element 210 according to temperature. In one embodiment, for example, the PTC resistance heating layer P10 is provided by dispersing about 150 phr of carbon black into PDMS, and the NTC resistance heating layer N10 is provided by dispersing about 12 phr of MWCNTs having an aspect ratio equal to or greater than 150 into PDMS. A range of a resistance ratio $R_P/R_N$ corresponding to the resistance changing ratio equal to or less than about ±10% or equal to or less than about ±40% at 30° C., 35° C., 40° C., and 48° C. may be determined or may be set to have a predetermined value. To satisfy the of the resistance ratio $R_P/R_N$ equal to or less than about ±10% or equal to or less than about ±40%, the thickness ratio $T_P/T_N$ or types and/or contents of electroconductive fillers dispersed into the PTC resistance heating layer P10 and the NTC resistance heating layer N10 may be determined. Referring back to FIG. 1, resistance of the commonly fabricated PTC resistance heating layer P10 is greater than resistance of the NTC resistance heating layer N10. Therefore, to embody the resistance heating element 210, which has a stacked structure and exhibits a resistance changing ratio of equal to or less than about ±40%, the resistance ratio $R_P/R_N$ may be 2 or greater, and more particularly, the resistance ratio $R_P/R_N$ may be in a range from about 4 to about 6.

(3) Island Structure

Figure 11:
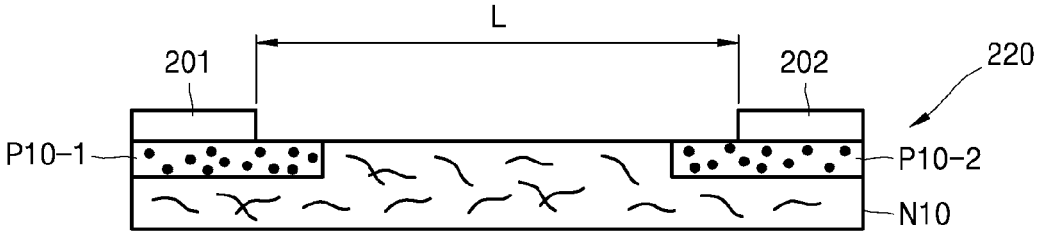
FIG. 11 is a diagram showing an embodiment of an resistance heating element, which is an island type resistance heating element.

FIG. 11 shows an embodiment of a resistance heating element 220 having a stacked structure according to the invention. In such an embodiment, the resistance heating element 220 has a modified stacked structure in which the PTC resistance heating layer P10 or the NTC resistance heating layer N10 is arranged as an island. In such an embodiment, as shown in FIG. 11, the resistance heating element 220 has a PTC on NTC structure, in which first and second portions of the PTC resistance heating layer P10-1 and P10-2 are arranged to be spaced apart from each other as islands. The NTC resistance heating layer N10 is disposed between and on the first and second portions of the PTC resistance heating layer P10-1 and P10-2. The electrodes 201 and 202 contact exposed surfaces of the first and second portions of the PTC resistance heating layer P10-1 and P10-2, respectively. The first and second portions of the PTC resistance heating layer P10-1 and P10-2 may include substantially the same material as each other. In such an embodiment, the first and second portions of the PTC resistance heating layer P10-1 and P10-2 may be provided by dispersing a same amount of particle type electroconductive fillers in same base polymers.

The embodiment shown in FIG. 11 is substantially the same as the embodiment described above. In such an embodiment, to reduce the resistance changing ratio of the resistance heating element 220 according to temperature, the electrodes 201 and 202 may be connected to one of the NTC resistance heating layer N10 and the first and second portions of the PTC resistance heating layer P10-1 and P10-2, which exhibits greater resistance, and the resistance changing ratio of one of the NTC resistance heating layer N10 and the first and second portions of the PTC resistance heating layer P10-1 and P10-2, in which more current flows, may be smaller than resistance changing ratio of the other of the NTC resistance heating layer N10 and the first and second portions of the PTC resistance heating layer P10-1 and P10-2. In such an embodiment, by changing the resistance ratio $R_P/R_N$ between the first and second portions of the PTC resistance heating layer P10-1 and P10-2 and the NTC resistance heating layer N10 in the stacked structure, the resistance changing ratio of the resistance heating element 220 having the stacked structure according to temperature may be controlled to be within a predetermined range, e.g., about ±40% (more particularly, about ±10%)

Figure 12:
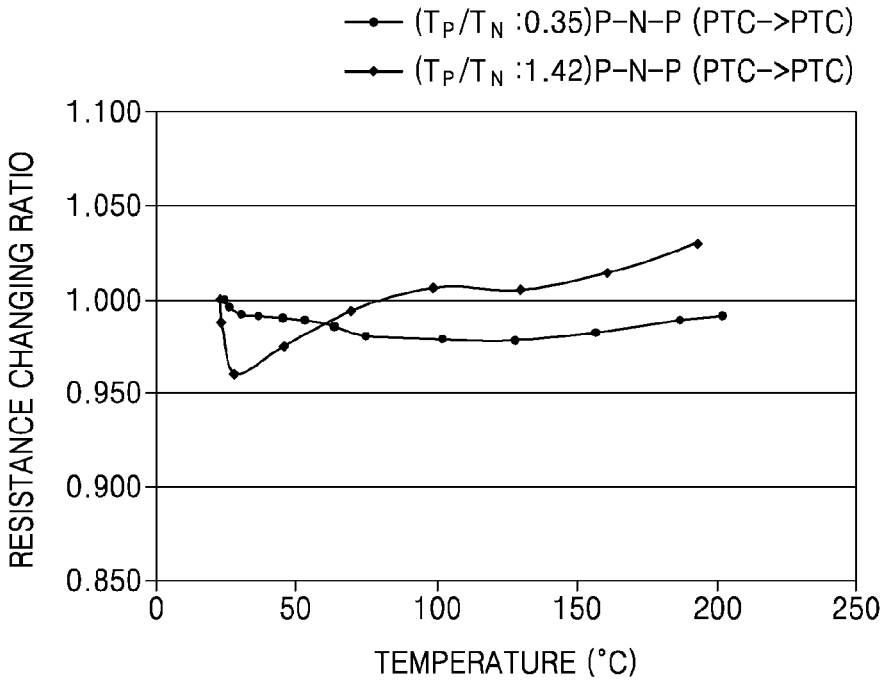
FIG. 12 is a diagram showing a relationship between temperature and resistance changing ratio according to thickness ratio in the island type resistance heating element shown in FIG. 11.

FIG. 12 is a graph showing resistance changing ratios of an embodiment of the resistance heating element 220 according to temperature, where the thickness ratios $T_P/T_N$ are about 0.35 and about 1.42, respectively. In one embodiment, for example, the first and second portions of the PTC resistance heating layer P10-1 and P10-2 are provided by dispersing about 150 phr of carbon black into PDMS, and the NTC resistance heating layer N10 is provided by dispersing about 12 phr of MWCNTs having an aspect ratio equal to or greater than 150 into PDMS. Referring to FIG. 12, resistance changing ratios vary according to the thickness ratios $T_P/T_N$. Since the resistance ratio $R_P/R_N$ may be changed by changing the thickness ratio $T_P/T_N$, the resistance heating element 220, which has the island structure and exhibits a predetermined resistance changing ratio, may be provided by controlling the resistance ratio $R_P/R_N$.

Figure 13A:
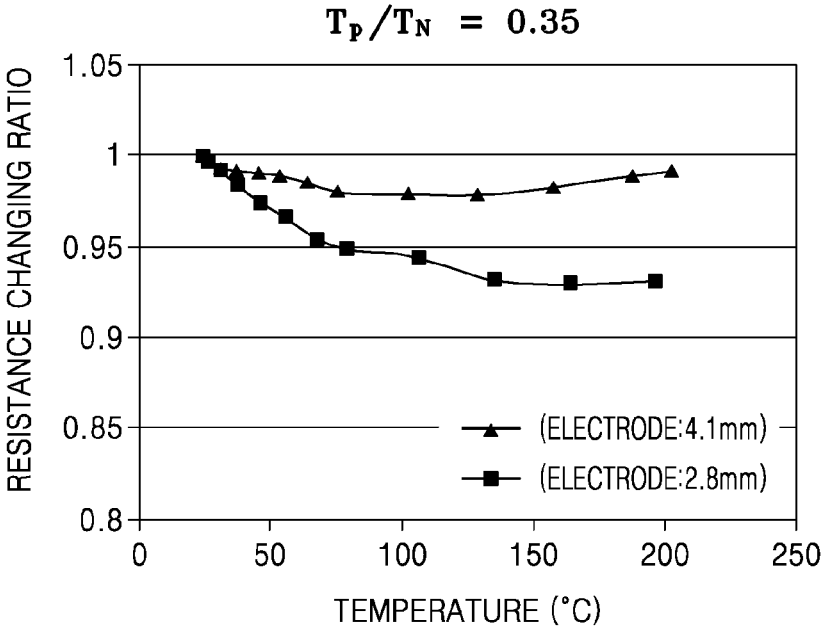
FIGS. 13A to 13C are graphs showing a relationship between temperature and resistance changing ratio according to thickness ratio and length of an electrode in the island type resistance heating element shown in FIG. 11.
Figure 13B:
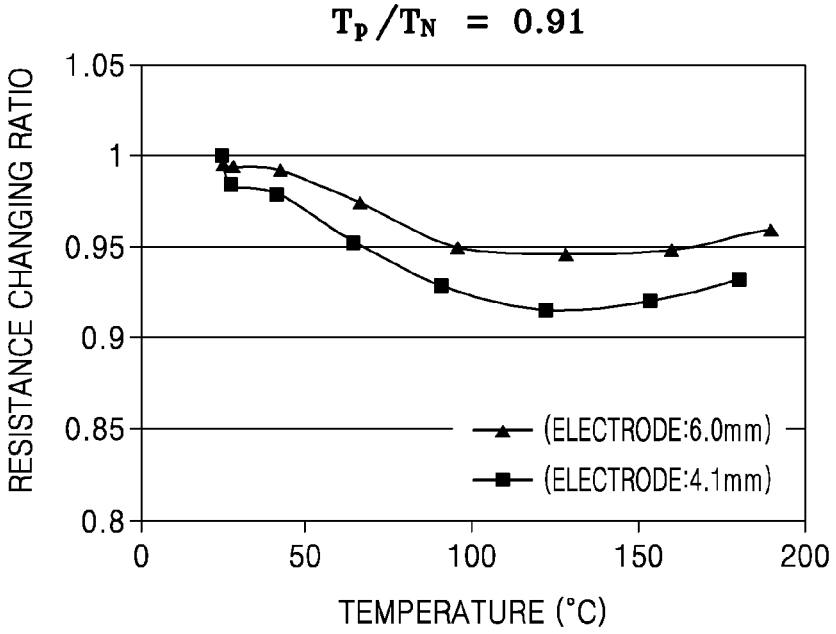
Figure 13C:
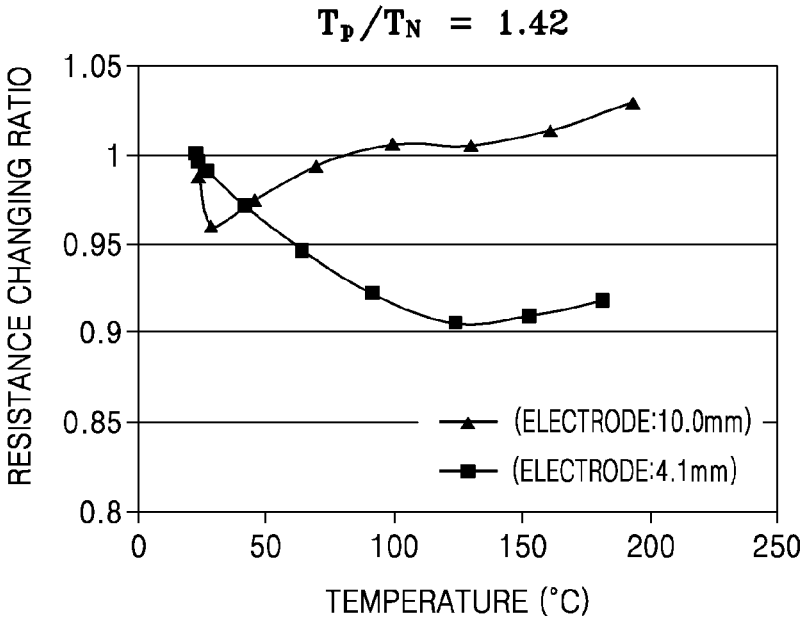

FIG. 13A is a graph showing resistance changing ratios in an embodiment where lengths, by which the electrodes 201 and 202 contact the resistance heating element 220 having the island structure and thickness ratio $T_P/T_N$ of 0.35, are about 4.1 mm and about 2.8 mm, respectively. FIG. 13B is a graph showing resistance changing ratios in an embodiment where lengths, by which the electrodes 201 and 202 contact the resistance heating element 220 having the island structure and thickness ratio $T_P/T_N$ of 0.91, are about 6.0 mm and about 4.1 mm, respectively. FIG. 13C is a graph showing resistance changing ratios in an embodiment where lengths, by which the electrodes 201 and 202 contact the resistance heating element 220 having the island structure and thickness ratio $T_P/T_N$ of 1.42, are about 10.0 mm and about 4.1 mm, respectively. As shown in FIGS. 13A, 13B and 13C, the resistance changing ratio of an embodiment of the resistance heating element 220 may be controlled to be within a predetermined range by changing lengths by which the electrodes 201 and 202 contact the resistance heating element 220.

Figure 14:
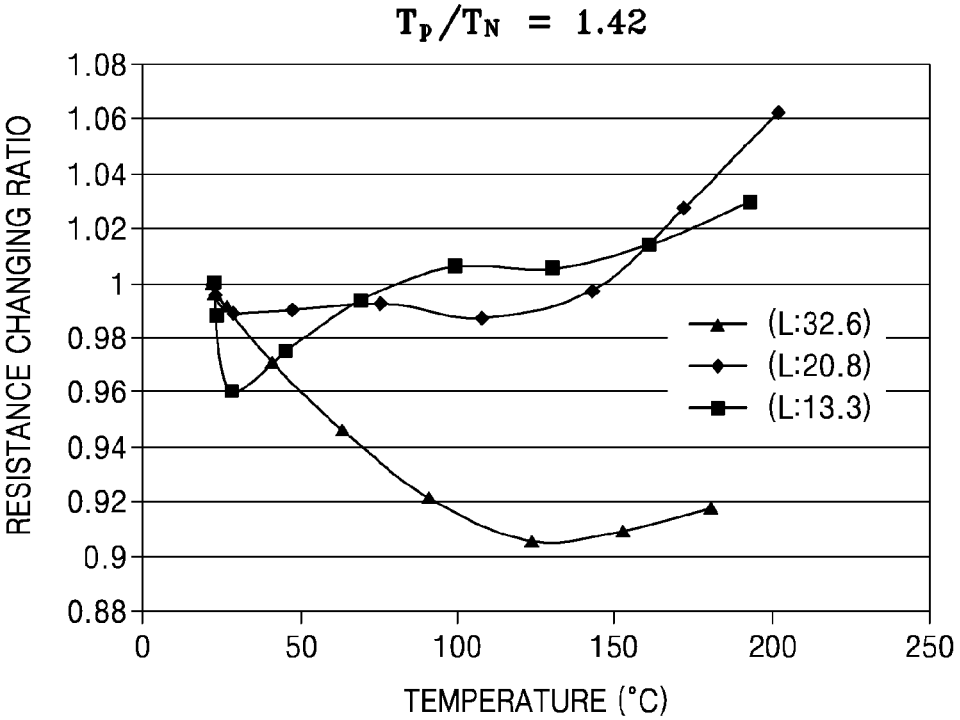
FIG. 14 is a graphs showing a relationship between temperatures and resistance changing ratios according to conductive lengths in the island type resistance heating element shown in FIG. 11.

FIG. 14 is a graph showing resistance changing ratios in embodiments of the resistance heating element 220 having the island structure and the thickness ratio $T_P/T_N$ of 1.42, where distances L between the electrodes 201 and 202 are about 32.6 mm, about 20.8 mm, and about 13.3 mm, respectively. Resistance changing ratios and warm-up times from the room temperature to 180° C. of the embodiments are shown in Table 3. As shown in FIG. 14 and Table 3, the resistance changing ratio of the resistance heating element 220 having the island structure may be controlled by controlling the distance L between the electrodes 201 and 202, that is, a conducting length.

TABLE 3

| | | | |
|---|---|---|---|
| Conducting Length(mm) | 32.6 | 20.8 | 13.3 |
| Initial Resistance(Ω) | 47.8 | 39.4 | 33.8 |
| Resistance Changing Ratio (%) | −8.2 | +3 | +3 |
| Warm-up Time (sec) | 50 | 18 | 10 |

As described above, an embodiment of the resistance heating element 210 and the resistance heating element 220 exhibiting resistance changing ratios within about ±40% or about ±10% may be provided by combining the PTC resistance heating layer P10 which exhibits a resistance changing ratio of exceeding about ±40% or about ±10% and the NTC resistance heating layer N10.

Figure 15:
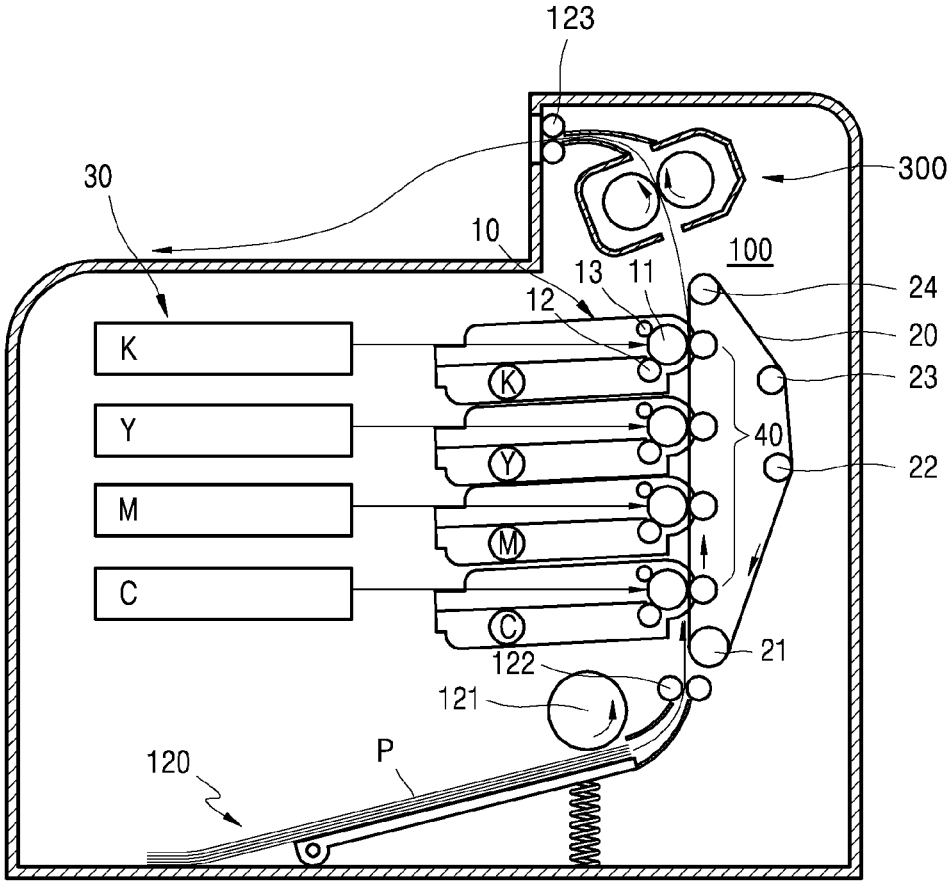
FIG. 15 is a cross-sectional view of an embodiment of an electrophotographic image forming apparatus including a fusing device including a heating element according to the invention.

FIG. 15 is a diagram showing an embodiment of electrophotographic image forming apparatus including a heating member and a fusing device according to the invention. Referring to FIG. 15, a printing unit 100 and a fusing device 300 for printing an image on a printing medium in an electrophotographic process are shown. An embodiment of the image forming apparatus shown in FIG. 15 may be a dry type electrophotographic image forming apparatus, which prints a color image using a dry type developer (referred to hereinafter as 'toner').

The printing unit 100 includes an exposing unit 30, a developing unit 10 and a transfer unit. To print a color image, an embodiment of the printing unit 100 includes four developing units 10C, 10M, 10Y and 10K in which toners of different colors, e.g., cyan (C) toner, magenta (M) toner, yellow (Y) toner and black (K) toner, are respectively accommodated, and four exposing units 30C, 30M, 30Y and 30K, corresponding to the developing units 10C, 10M, 10Y and 10K, respectively.

Each of the developing units 10C, 10M, 10Y and 10K includes a photosensitive drum 11, which is an image receptor, on which an electrostatic latent image is formed, and a developing roller 12 for developing the electrostatic latent image. A charge bias voltage is applied to a charge roller 13 of each of the developing units 10C, 10M, 10Y and 10K to charge the outer surface of the photosensitive drum 11 to a uniform electric potential. In an alternative embodiment, a coroner discharger (not shown) may be provided instead of the charge roller 13. The developing roller 12 attaches toner to the outer surface thereof and supplies the toner to the photosensitive drum 11. A developing bias voltage for supplying toner to the photosensitive drum 11 is applied to the developing roller 12. In an embodiment, each of the developing units 10C, 10M, 10Y and 10K may further include a supplying roller (not shown) for attaching toner accommodated therein to the developing roller 12, a regulation unit (not shown) for regulating amount of toner attached to the developing roller 12, an agitator (not shown) which transports toner accommodated therein toward the supplying roller and/or the developing roller 12, for example. In an embodiment, each of the developing units 10C, 10M, 10Y and 10K may further include a cleaning blade (not shown) for removing toner attached to the outer surface of the photosensitive drum 11 before the photosensitive drum 11 is charged and an accommodating space (not shown) for accommodating the removed toner.

In an embodiment, as shown in FIG. 15, the transfer unit may include a printing medium transferring belt 20 and four transfer rollers 40. The printing medium transferring belt 20 disposed facing the outer surfaces of the photosensitive drums 11 exposed out of the developing units 10C, 10M, 10Y and 10K. The printing medium transferring belt 20 is supported by a plurality of supporting rollers 21, 22, 23 and 24 and circulates. In such an embodiment, the printing medium transferring belt 20 is installed substantially in a vertical direction, e.g., a vertical direction with respect to a bottom surface of the printing unit 100. The four transfer rollers 40 are disposed to face the photosensitive drums 11 of the developing units 10C, 10M, 10Y and 10K, respectively, while interposing the printing medium transferring belt 20 therebetween. Transfer bias voltage is applied to the transfer rollers 40. The exposing units 30C, 30M, 30Y and 30K scan lights corresponding to cyan (C), magenta (M), yellow (Y) and black (K) image data to the photosensitive drums 11 of the developing units 10C, 10M, 10Y and 10K, respectively. In such an embodiment, laser scanning units ("LSU") which include laser diodes as light sources may be provided as the exposing units 30C, 30M, 30Y and 30K.

Hereinafter, an embodiment of a process of forming a color image using the embodiment of electrophotographic image forming apparatus shown in FIG. 15 will be described in detail.

The photosensitive drum 11 of each of the developing units 10C, 10M, 10Y and 10K is charged to a uniform electric potential by a charge bias voltage applied to the charge roller 13. The four exposing units 30C, 30M, 30Y and 30K form electrostatic latent images by scanning lights corresponding to cyan (C), magenta (M), yellow (Y) and black (K) image data to the photosensitive drums 11 of the developing units 10C, 10M, 10Y and 10K, respectively. Developing bias voltage is applied to the developing rollers 12. Then, toners attached to the outer surfaces of the developing rollers 12 are attached to the electrostatic latent images, and cyan (C), magenta (M), yellow (Y) and black (K) toner images are formed on the photosensitive drums 11 of the developing units 10C, 10M, 10Y and 10K, respectively.

A medium for final accommodation of toner images, e.g., a printing medium P, is picked up from a cassette 120 by a pickup roller 121. The printing medium P is introduced to the printing medium transferring belt 20 by the transfer roller 122. The printing medium P is attached to a surface of the printing medium transferring belt 20 via electrostatic force and is transferred at substantially the same speed as the speed at which the printing medium transferring belt 20 is driven.

In one embodiment, for example, a leading edge of the printing medium P reaches a transfer nib at a time point, at which a leading edge of a cyan (C) toner image formed on the outer surface of the photosensitive drum 11 of the developing unit 10C reaches the transfer nib. When transfer bias voltage is applied to the transfer roller 40, the toner image formed on the photosensitive drum 11 is transferred to the printing medium P. As the printing medium P is being transferred, the magenta (M), yellow (Y) and black (K) toner images formed on the photosensitive drums 11 of the developing units 10M, 10Y and 10K are sequentially transferred and superimposed onto the printing medium P, and thus a color toner image is formed on the printing medium P.

The color toner image transferred to the printing medium P is maintained on the surface of the printing medium P by electrostatic force. The fusing device 300 fuses the color toner image to the printing medium P by applying heat and pressure. The fused printing medium P is discharged out of the image forming apparatus by a discharging roller 123.

In such an embodiment, the fusing device 300 is heated to a temperature close to a predetermined fusing temperature to form an image. The shorter the warm-up time is, the faster the first page may be printed out after a printing command is received. Generally, the fusing device 300 may only be heated during a printing task and may not be operated in stand-by mode. However, when another printing task is started, the fusing device 300 is re-heated. In an embodiment, to reduce the period of time elapsed for starting another printing task, the fusing device 300 may be controlled to maintain a predetermined temperature in stand-by mode. In such an embodiment, the temperature of the fusing device 300 in the stand-by mode may be maintained at a predetermined temperature, e.g., a temperature in a range from about 120° C. to about 180° C. In an embodiment, where a period of time elapsed for heating the fusing device 300 to a temperature for performing a printing task is sufficiently reduced, the fusing device 300 may be maintained at a temperature lower than the predetermined temperature in stand-by mode, and thus energy consumed by the fusing device 300 may be reduced.

Figure 16:
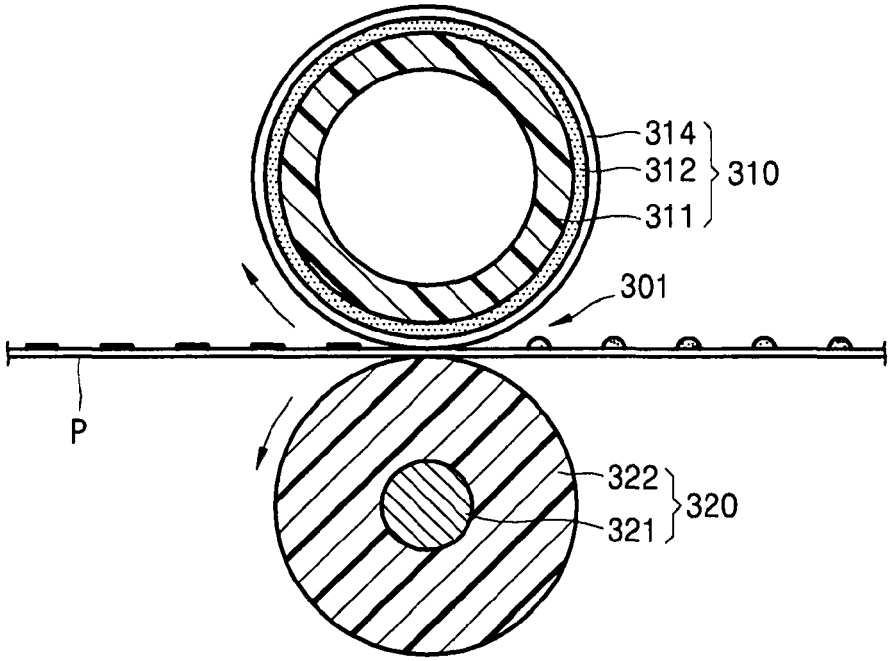
FIG. 16 is a schematic sectional view of an embodiment of the fusing device, which is a roller-type fusing device, according to the invention.

FIG. 16 is a diagram showing an embodiment of the fusing device 300 according to the invention. In an embodiment, as shown in FIG. 16, the fusing device 300 may be a roller-type fusing device including a roller-type heating member. Referring to FIG. 16, the fusing device 300 includes a heating member 310 and a nib forming unit facing the heating member 310, and the heating member 310 and the nib forming unit collectively defined a fusing nib 301. In such an embodiment, the heating member 310 includes a resistance heating element 312, a supporting unit 311 that supports the resistance heating element 312, and a releasing layer 314. The nib forming unit includes a pressing member 320 facing the heating member 310. The heating member 310 and the pressing member 320 are biased by a bias unit (not shown) such as a spring in direction to engage with each other. In one embodiment, for example, the pressing member 320 is a roller-like member including a metal support 321 and an elastic layer 322 disposed on the metal support 321. In such an embodiment, as the elastic layer 322 of the pressing member 320 is partially deformed, the fusing nib 301, via which heat is transferred from the heating member 310 to a toner on the printing medium P, is formed. The heating member 310, which is a roller-like member as shown in FIG. 16, of the fusing device 300 of an electrophotographic image forming apparatus is generally referred to as a fusing roller.

Figure 17:
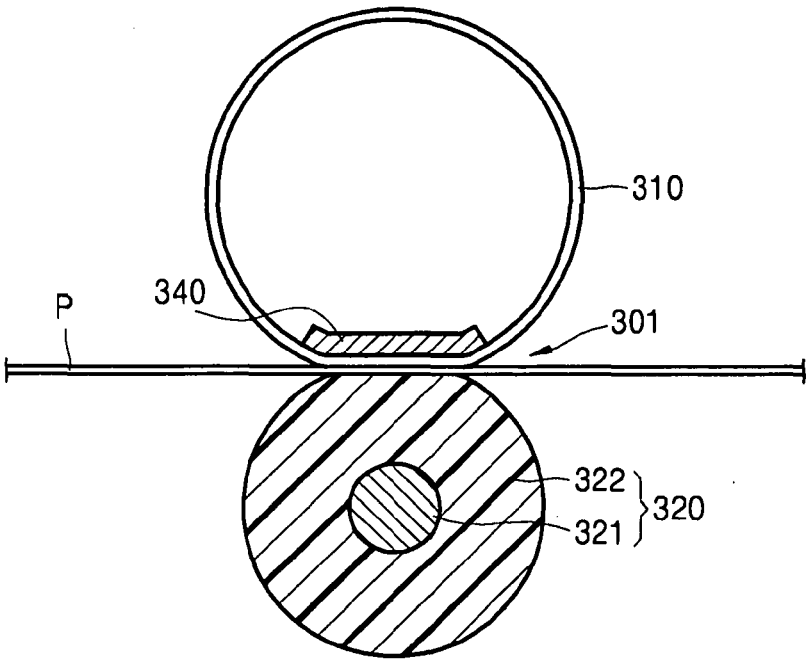
FIG. 17 is a schematic sectional view of an embodiment of the fusing device, a belt-type fusing device, according to the invention.

FIG. 17 shows an alternative embodiment of the fusing device 300 according to the invention. The embodiment of the fusing device 300 shown in FIG. 17 is substantially the same as the embodiment of the fusing device 300 shown in FIG. 15 except for the heating member 310 having a belt-like supporting unit 311. The heating member 310 as shown in FIG. 17 is generally referred to as a fusing belt. Referring to FIG. 17, the nib forming unit may include the pressing member 320 and a nib forming member 340 that is arranged inside the belt-like heating member 310 forming a closed-loop. The pressing member 320 is arranged outside the heating member 310. In such an embodiment, to form the fusing nib 301, the nib forming member 340 and the pressing member 320 are engaged with each other and rotate while interposing the heating member 310 therebetween. A bias unit (not shown) applies elastic force to the nib forming member 340 and/or the pressing member 320 in direction in which the nib forming member 340 and the pressing member 320 engage with each other. In one embodiment, for example, the nib forming member 340 may be pressed toward the pressing member 320. In an embodiment, the nib forming member 340 may be an elastic roller type member (not shown) that rotates together with the pressing member 320 and drives the heating member 310.

FIGS. 18 to 21 are schematic cross-sectional views of embodiments of the heating member 310 of the fusing devices 300 shown in FIGS. 16 and 17. The heating member 310 may include a resistance heating element 312 and a supporting unit 311 that supports the resistance heating element 312. A releasing layer 314 may be further provided on outer surfaces of the resistance heating element 312. An elastic layer 313 may be further arranged between the resistance heating element 312 and the releasing layer 314 to secure the sufficient fusing nib 301. The elastic layer 313 may include a same material as the base polymer of the resistance heating element 312 and/or the releasing layer 314.

In an embodiment, the supporting unit 311 may include a polymer-based material, e.g., polyimide, polyimideamide and fluoropolymers, for example, or a metal. In such an embodiment, the fluoropolymers may include fluorinated PEEK, PTFE, PFA and FEP, for example. In such an embodiment, the metal may include a stainless steel, nickel, copper, brass, and alloys thereof. However, materials for forming the supporting unit 311 are not limited to the materials stated above. In an embodiment, where the supporting unit 311 includes a conductive metal, an insulation layer (not shown) may be interposed between the supporting unit 311 and the resistance heating element 312. In an embodiment, an insulation layer (not shown) may be interposed between electrodes 315 and 316, which will be described below, and the supporting unit 311.

In an embodiment including a roller-type heating member, the supporting unit 311 may have a hollow pipe-like shape. In such an embodiment, the supporting unit 311 may include a material having a substantially high hardness to not to be excessively deformed by a pressure for forming the fusing nib 301. In an embodiment of a belt-type heating member, the supporting unit 311 may be configured to have a sufficient flexibility to be flexibly deformed at the fusing nib 301 and to be recovered from the deformation after the supporting unit 311 passes the fusing nib 301.

The releasing layer 314 defines the outermost layer of the heating member 310. During a fusing process, an offset, in which a toner on the printing medium P is fused and attached to the heating member 310, may occur. The offset may cause a printing defect that may occur when an image printed on the printing medium P is partially omitted and a jam that may occur when the printing medium P passed a fusing nib is not separated from the heating member 310 and is attached to a surface of the heating member 310. The releasing layer 314 may include a highly releasable polymer layer to effectively prevent a toner from being attached to the heating member 310. The releasing layer 314 may include a silicon-based polymer or a fluorine-based polymer, for example. The fluorine-based polymer may be polyperfluoroethers, fluorinated polyethers, fluorinated polyimides, PEEK, fluorinated polyamides, fluorinated polyesters, etc., for example. The releasing layer 314 may be one of the above-stated polymers, or a blend or copolymer of two or more of the above-stated polymers.

In such an embodiment, the electrodes 315 and 316 are arranged on the supporting unit 311 to be apart from each other in the width-wise direction and contact the resistance heating element 312. Current is supplied to the resistance heating element 312 via the electrodes 315 and 316. In one embodiment, for example, the electrodes 315 and 316 may be an input electrode and an output electrode respectively. The electrodes 315 and 316 may include a highly conductive metal, e.g., copper, silver, etc.

When the resistance heating element 312 is driven by a constant voltage (V), input power input to the resistance heating element 312 may be indicated as $V^2/R$, where R denotes the resistance of the resistance heating element 312. Accordingly, if the resistance R of the resistance heating element 312 is changed, the input power is changed. If the resistance R of the resistance heating element 312 gradually decreases or increases during warm-up, the input power gradually increase or decreases. In an embodiment, the input power may be restricted such that an excessive current flow is effectively prevented when the resistance of the resistance heating element 312 is decreased, and thus the resistance heating element 312 may be effectively prevented from being overheated during warm-up. Excessive current may cause a thermal shock to a base polymer and deteriorates durability of the resistance heating element 312, and thus risk of overheating or fire due to the overheating may increase. Therefore, in such an embodiment, the maximum input power is set to not to overheat the resistance heating element 312 based on the lowest resistance of the resistance heating element 312. In such an embodiment, where the resistance changing ratio of the resistance heating element 312 is large, the upper limit of the maximum input power is substantially lowered, thereby increasing warm-up time. In such an embodiment, the resistance changing ratio of the resistance heating element 312 is substantially reduced while temperature rises from the room temperature to a fusing temperature (e.g., 200° C.) to be, for example, within about ±10% range to effectively prevent overheat and reduce warm-up time.

Figure 18:
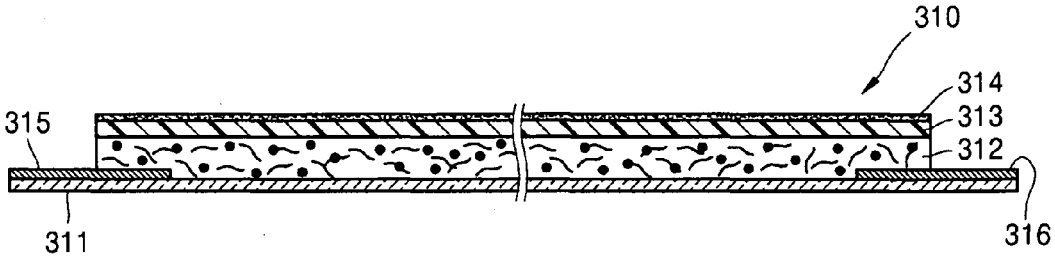
FIG. 18 is a cross-sectional view of an embodiment of a heating element according to the invention.

FIG. 18 is a schematic cross-sectional diagram of an embodiment of the heating member 310 of the fusing devices 300 shown in FIGS. 16 and 17. In such an embodiment, the heating member 310 includes the resistance heating element (200 of FIG. 3) having the hybrid structure, in which particle type electroconductive fillers and fiber type electroconductive fillers are dispersed in a base polymer. The particle type electroconductive fillers may be electroconductive fillers having an aspect ratio less than about 10, and the fiber type electroconductive fillers may be electroconductive fillers having an aspect ratio equal to or greater than about 10. In one embodiment, for example, the particle type electroconductive fillers may be carbon black or fullerene, and the fiber type electroconductive fillers may be CNTs. In such an embodiment, contents of the particle type electroconductive fillers and the fiber type electroconductive fillers may have predetermined values, such that the resistance changing ratio of the resistance heating element 312 during warm-up is, for example, within about ±10%. In an embodiment, where content of the particle electroconductive fillers is high, the resistance heating element 312 may exhibit overall PTC characteristics, where the fiber type electroconductive fillers function as conductive bridges between the particle type electroconductive fillers and buffers the PTC characteristics. In an embodiment, where content of the fiber type electroconductive fillers is high, the resistance heating element 312 may exhibit overall NTC characteristics, where PTC characteristics of the particle type electroconductive fillers may buffer the NTC characteristics. As described above, in an embodiment, the resistance heating element 312 having a predetermined resistance changing ratio may be provided by effectively controlling contents of the particle type electroconductive fillers and the fiber type electroconductive fillers. In an embodiment, as contents of electroconductive fillers increase, electric conductivity of the resistance heating element 312 increases, and thus the fusing device 300 may be warmed up quickly. However, in such an embodiment, the resistance heating element 312 may have an excessive stiffness. The resistance heating element 312 and the pressing member 320 collectively define the fusing nib 301. Here, if the resistance heating element 312 has an excessive stiffness, the fusing nib 301 having a sufficient size may not be effectively formed. Furthermore, high stiffness may deteriorate mechanical properties of the resistance heating element 312, thereby deteriorating lifespan of the heating member 310. Therefore, in such an embodiment, contents of the electroconductive fillers is set to have a predetermined value based on the mechanical properties of the resistance heating element 312 and size of the fusing nib 301 of the fusing device 300.

Figure 19:
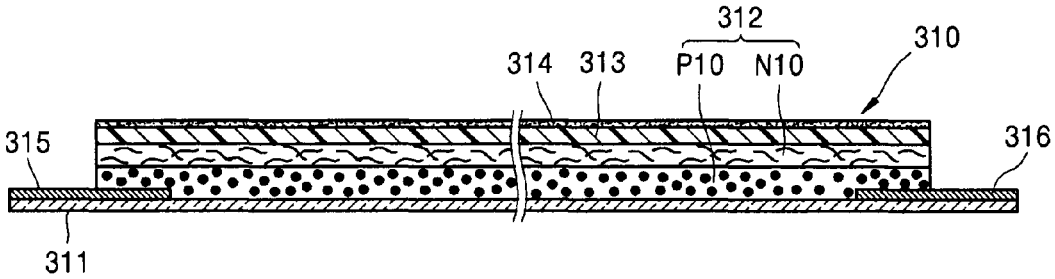
FIG. 19 is a cross-sectional view of an alternative embodiment of a heating element according to the invention.

FIG. 19 is a schematic cross-sectional view of an alternative embodiment of the heating member 310 of the fusing devices 300 shown in FIGS. 16 and 17. In such an embodiment, the heating member 310 includes the resistance heating element 210 having the stacked structure as shown in FIGS. 5A to 5D as the resistance heating element 312. The stacked structure may be the NTC on PTC structure or the PTC on NTC structure. The current path may be the NTC to PTC structure, the PTC to NTC structure, the NTC to NTC structure, or the PTC to PTC structure. In an embodiment, the resistance heating element 210 may have the NTC to NTC structure or the PTC to PTC structure such that a substantially small resistance changing ratio may be obtained. Also, the input electrode 315 and the output electrode 316 are connected to one of the NTC resistance heating layer N10 and the PTC resistance heating layer P10, which has greater resistance. The other of the NTC resistance heating layer N10 and the PTC resistance heating layer P10, to which the electrodes 315 and 316 are not connected, provides the main path of a current, and thus content of electroconductive fillers in the other of the NTC resistance heating layer N10 and the PTC resistance heating layer P10 to which the electrodes 315 and 316 are not connected, may be determined or set to have a predetermined value to have a smaller resistance changing ratio than the one of the NTC resistance heating layer N10 and the PTC resistance heating layer P10 to which the electrodes 315 and 316 are connected. In an embodiment, as shown in FIG. 19, the resistance heating element 312 has the NTC on PTC (PTC to PTC) structure. In such an embodiment, the electrodes 315 and 316 are arranged at both sides of the supporting unit 311 in the width-wise direction, and the PTC resistance heating layer P10 is configured to contact the electrodes 315 and 316. The NTC resistance heating layer N10 is arranged on the PTC resistance heating layer P10. In an embodiment, the elastic layer 313 and/or the releasing layer 314 may be further arranged on the NTC resistance heating layer N10. As described above with reference to FIGS. 6, 7, 8A to 8C, 9A to 9C, and 10, the resistance heating element 312 has a resistance changing ratio within a predetermined range (e.g., about ±10%) by controlling the resistance ratio $R_P/R_N$ between the NTC resistance heating layer N10 and the PTC resistance heating layer P10. The resistance ratio $R_P/R_N$ may be controlled by controlling the thickness ratio $T_P/T_N$ and/or contents of the electroconductive fillers.

Figure 20:
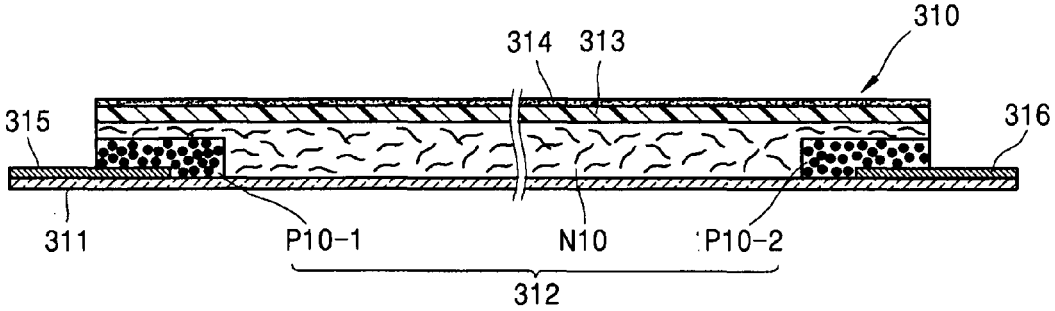
FIG. 20 is a cross-sectional view of another alternative embodiment of a heating element according to the invention.

FIG. 20 is a schematic cross-sectional view of another alternative embodiment of the heating member 310 of the fusing devices 300 shown in FIGS. 16 and 17. In such an embodiment, the heating member 310 includes the resistance heating element 220 having the island structure as shown in FIG. 11 as the resistance heating element 312. The island structure may be a stacked structure, e.g., the NTC on PTC structure or the PTC on NTC structure. The current path may be the NTC to NTC structure or the PTC to PTC structure. In an embodiment, the input electrode 315 and the output electrode 316 may be connected to one of the NTC resistance heating layer N10 and the first and second portions of the PTC resistance heating layer P10-1 and P10-2, which has greater resistance, to obtain a substantially small resistance changing ratio. Content of electroconductive fillers in the other of the NTC resistance heating layer N10 and the first and second portions of the PTC resistance heating layer P10-1 and P10-2, to which the electrodes 315 and 316 are not connected, operates as the main path of a current, content of electroconductive fillers in the other of the NTC resistance heating layer N10 and the first and second portions of the PTC resistance heating layer P10-1 and P10-2, to which the electrodes 315 and 316 are not connected may be configured to have a smaller resistance changing ratio than the one of the NTC resistance heating layer N10 and the first and second portions of the PTC resistance heating layer P10-1 and P10-2, to which the electrodes 315 and 316 are not connected to which the electrodes 315 and 316 are connected. In an embodiment, as shown in FIG. 20, the resistance heating element 312 may have the NTC on PTC (PTC to PTC) structure. The electrodes 315 and 316 are arranged at both sides of the supporting unit 311 in the width-wise direction, and the first and second portions of the PTC resistance heating layer P10-1 and P10-2 are arranged as islands to contact the electrodes 315 and 316, respectively. The NTC resistance heating layer N10 is arranged between the first and second PTC resistance heating layers P10-1 and P10-2 and on the first and second PTC resistance heating layers P10-1 and P10-2. In an embodiment, the first and second PTC resistance heating layers P10-1 and P10-2 may include substantially the same material as each other. In such an embodiment, the first and second PTC resistance heating layers P10-1 and P10-2 may be provided by dispersing a same amount of particle type electroconductive fillers in same base polymers.

As described above with reference to FIGS. 6, 7, 8A to 8C, 9A to 9C, and 10, an embodiment of the resistance heating element 312 has a resistance changing ratio within a predetermined range (e.g., about ±10%) by controlling the resistance ratio $R_P/R_N$ between the NTC resistance heating layer N10 and the PTC resistance heating layer P10. The resistance ratio $R_P/R_N$ may be controlled by controlling the thickness ratio $T_P/T_N$ and/or contents of the electroconductive fillers. In an embodiment, as described above with reference to FIGS. 13A to 13C and 14, the resistance heating element 312 has a resistance changing ratio within a predetermined range (e.g., about ±10%) by controlling lengths by which the electrodes 315 and 316 contact the first and second PTC resistance heating layers P10-1 and P10-2 and/or a conductive length (a distance between the electrodes 315 and 316).

(4) Serial Structure

Figure 21:
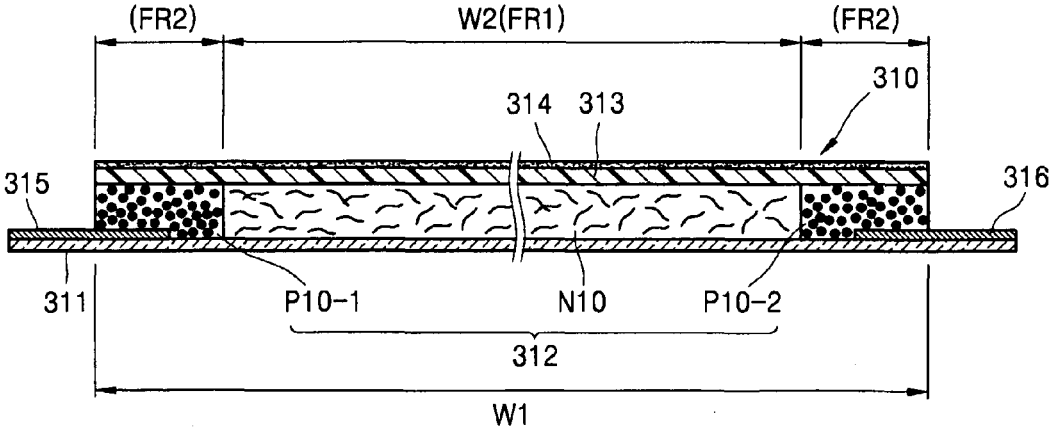
FIG. 21 is a cross-sectional view of another alternative embodiment of a heating element according to the invention.

FIG. 21 is a schematic cross-sectional view of another alternative embodiment of the heating member 310 of the fusing devices 300 shown in FIGS. 16 and 17. In such an embodiment, the heating member 310 may include the resistance heating element 312 having a structure substantially the same as the structure of the resistance heating element 220 having the island structure shown in FIG. 11 except that the PTC resistance heating layer P10 and the NTC resistance heating layer N10 are connected in series. In such an embodiment, the structure of the resistance heating element 312 may be PTC-NTC-PTC structure or NTC-PTC-NTC structure. In one embodiment, as shown in FIG. 21, for example, the resistance heating element 312 may be the PTC-NTC-PTC type resistance heating element 312. The electrodes 315 and 316 are arranged at both sides of the supporting unit 311 in the width-wise direction. The first and second PTC resistance heating layers P10-1 and P10-2 are arranged to contact the electrodes 315 and 316, respectively. The NTC resistance heating layer N10 is arranged between the first and second PTC resistance heating layers P10-1 and P10-2. In an embodiment, the first and second PTC resistance heating layers P10-1 and P10-2 may include substantially the same material as each other. In such an embodiment, the first and second PTC resistance heating layers P10-1 and P10-2 may be provided by dispersing a same amount of particle type electroconductive fillers in same base polymers.

Power supplied to the resistance heating element 312 during a fusing process is controlled to maintain temperature of the resistance heating element 312 at a fusing temperature, e.g., about 180° C. In general, width W1 of the resistance heating element 312 in the heating member 310 is greater than width W2 of a feeding region FR1 at which the printing medium P passes for fusion. The two opposite ends of the feeding region FR1 is a non-feeding region FR2 in which the printing medium P does not pass. Heat is transferred from the resistance heating element 312 to the printing medium P in the feeding region FR1, where the power supplied to the resistance heating element 312 is controlled based on the heat transfer to maintain the entire resistance heating element 312 at the fusing temperature. However, heat is not transferred in the non-feeding region FR2, the non-feeding region FR2 may be overheated to a temperature exceeding the fusing temperature. Repeated overheating of the non-feeding region FR2 may cause damages to the resistance heating element 312 and the heating member 310. As shown in FIG. 1, resistances of the first and second PTC resistance heating layers P10-1 and P10-2 rapidly increase as temperatures thereof exceed about 40° C., and currents flowing therein rapidly decrease. Therefore, in such an embodiment, the non-feeding region FR2 may be effectively prevented from being overheated by the first and second PTC resistance heating layers P10-1 and P10-2 in the non-feeding region FR2. The electrodes 315 and 316 may contact only the first and second PTC resistance heating layers P10-1 and P10-2. In such an embodiment, as shown in FIG. 21 by dotted lines, the electrodes 315 and 316 may partially contact the NTC resistance heating layer N10.

The above embodiments are described in relation to a case where a resistance heating element and a heating member are applied to a fusing device of an electrophotographic image forming apparatus. However, applications of the resistance heating element and the heating members are not limited thereto, and the resistance heating element and the heating members may be applied to any of various devices including a heat generating unit for generating heat using electricity.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A resistance heating element comprising:

a positive temperature coefficient resistance heating layer having a positive temperature coefficient;

a negative temperature coefficient resistance heating layer, which is electrically connected to the positive temperature coefficient resistance heating layer and has a negative temperature coefficient;

wherein the positive temperature coefficient resistance heating layer comprises:

a first base polymer; and first electroconductive fillers, which are dispersed in the first base polymer and form a first conductive network, and the negative temperature coefficient resistance heating layer comprises:

a second base polymer; and second electroconductive fillers, which are dispersed in the second base polymer and form a second conductive network.

2. The resistance heating element of claim 1, wherein an aspect ratio of the first electroconductive fillers is less than about 10, and an aspect ratio of the second electroconductive fillers is equal to or greater than about 10.

3. The resistance heating element of claim 1, wherein a resistance changing ratio of the positive temperature coefficient resistance heating layer according to temperature is equal to or greater than about 10%.

4. The resistance heating element of claim 1, wherein a resistance changing ratio of the negative temperature coefficient resistance heating layer according to temperature is equal to or greater than about 10%.

5. The resistance heating element of claim 1, further comprising:

an input electrode and an output electrode, which supply currents to the resistance heating element, wherein the positive temperature coefficient resistance heating layer and the negative temperature coefficient resistance heating layer have one of a structure in which the positive temperature coefficient resistance heating layer' and the negative temperature coefficient resistance heating layer are stacked, a structure in which the negative temperature coefficient resistance heating layer is arranged on and between first and second portions of the positive temperature coefficient resistance heating layer, which are spaced apart from each other, and a structure in which the negative temperature coefficient resistance heating layer is arranged between the first and second portions of the positive temperature coefficient resistance heating layer, and the input electrode and the output electrode have one of a structure in which the input electrode and the output electrode are connected to the positive temperature coefficient resistance heating layer, a structure in which the input electrode and the output electrode are connected to the negative temperature coefficient resistance heating layer, and a structure in which the input electrode is connected to one of the positive temperature coefficient resistance heating layer and the negative temperature coefficient resistance heating layer and the output structure is connected to the other of the positive temperature coefficient resistance heating layer and the negative temperature coefficient resistance heating layer.

6. The resistance heating element of claim 1, wherein a resistance ratio of resistance of the positive temperature coefficient resistance heating layer with respect to resistance of the negative temperature coefficient resistance heating layer has a predetermined value, such a resistance changing ratio of the resistance heating element is within about ±40%.

7. The resistance heating element of claim 1, further comprising:

an input electrode and an output electrode, which supply currents to the resistance heating element, wherein the input electrode and the output electrode are connected to one of the positive temperature coefficient resistance heating layer and the negative temperature coefficient resistance heating layer, which has greater resistance.

8. The resistance heating element of claim 7, wherein resistance changing ratio of the other of the positive temperature coefficient resistance heating layer and the negative temperature coefficient resistance heating layer, to which the input electrode and the output electrode are not connected, is less than resistance changing ratio of the one of the positive temperature coefficient resistance heating layer and the negative temperature coefficient resistance heating layer, to which the input electrode and the output electrode are connected.

9. The resistance heating element of claim 7, wherein the input electrode and the output electrode are connected to the positive temperature coefficient resistance heating layer, and a resistance ratio of resistance of the positive temperature coefficient resistance heating layer with respect to resistance of the negative temperature coefficient resistance heating layer is greater than or equal to about 2.

10. A heating member comprising:

an input electrode;

an output electrode;

a resistance heating element which generates heat using electricity supplied thereto via the input electrode and the output electrode; and a supporting unit which supports the resistance heating element, wherein the resistance heating element comprises:

a positive temperature coefficient resistance heating layer having a positive temperature coefficient; and a negative temperature coefficient resistance heating layer, which is electrically connected to the positive temperature coefficient resistance heating layer and has a negative temperature coefficient;

wherein the positive temperature coefficient resistance heating layer comprises:

a first base polymer; and first electroconductive fillers which are dispersed in the first base polymer and form a first conductive network, and the negative temperature coefficient resistance heating layer comprises:

a second base polymer; and second electroconductive fillers which are dispersed in the second base polymer and form a second conductive network.

11. The heating member of claim 10, wherein an aspect ratio of the first electroconductive fillers is less than about 10, and an aspect ratio of the second electroconductive fillers is equal to or greater than about 10.

12. The heating member of claim 10, wherein the positive temperature coefficient resistance heating layer and the negative temperature coefficient resistance heating layer have one of a structure in which the positive temperature coefficient resistance heating layer and the negative temperature coefficient resistance heating layer are stacked, a structure in which the negative temperature coefficient resistance heating layer is arranged on and between first and second portions of the positive temperature coefficient resistance heating layers, which are spaced apart from each other, and a structure in which the negative temperature coefficient resistance heating layer is arranged between the first and second portions of the positive temperature coefficient resistance heating layer, and the input electrode and the output electrode have one of a structure in which the input electrode and the output electrode are connected to the positive temperature coefficient resistance heating layer, a structure in which the input electrode and the output electrode are connected to the negative temperature coefficient resistance heating layer, and a structure in which the input electrode is connected to one of the positive temperature coefficient resistance heating layer and the negative temperature coefficient resistance heating layer and the output structure is connected to the other of the positive temperature coefficient resistance heating layer and the negative temperature coefficient resistance heating layer.

13. The heating member of claim 12, wherein a resistance ratio of resistance of the positive temperature coefficient resistance heating layer with respect to resistance of the negative temperature coefficient resistance heating layer has a predetermined value, such that a resistance changing ratio of the resistance heating element is within about ±10%.

14. The heating member of claim 12, wherein the input electrode and the output electrode are connected to one of the positive temperature coefficient resistance heating layer and the negative temperature coefficient resistance heating layer, which has greater resistance.

15. The heating member of claim 14, wherein resistance changing ratio of the other of the positive temperature coefficient resistance heating layer and the negative temperature coefficient resistance heating layer, to which the input electrode and the output electrode are not connected, is less than resistance changing ratio of the one of the positive temperature coefficient resistance heating layer and the negative temperature coefficient resistance heating layer, to which the input electrode and the output electrode are connected.

16. The heating member of claim 10, wherein the supporting unit has a hollow pipe-like shape.

17. The heating member of claim 10, wherein the supporting unit has a belt-like shape.

18. A fusing device comprising:

a heating member comprising:

an input electrode;

an output electrode;

a resistance heating element which generates heat using electricity supplied thereto via the input electrode and the output electrode; and a supporting unit which supports the resistance heating element, wherein the resistance heating element comprises:

a positive temperature coefficient resistance heating layer having a positive temperature coefficient;

a negative temperature coefficient resistance heating layer, which is electrically connected to the positive temperature coefficient resistance heating layer and has a negative temperature coefficient; and a nib forming unit, which faces the heating member and forms a fusing nib;

wherein the positive temperature coefficient resistance heating layer comprises:

a first base polymer; and first electroconductive fillers which are dispersed in the first base polymer and form a first conductive network, and the negative temperature coefficient resistance heating layer comprises:

a second base polymer; and second electroconductive fillers which are dispersed in the second base polymer and form a second conductive network.

* * * * *